US007964090B2

(12) United States Patent
Iqbal

(10) Patent No.: US 7,964,090 B2
(45) Date of Patent: Jun. 21, 2011

(54) INTEGRATED SOLVENT DEASPHALTING AND GASIFICATION

(75) Inventor: Rashid Iqbal, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 423 days.

(21) Appl. No.: 12/128,409

(22) Filed: May 28, 2008

(65) Prior Publication Data

US 2009/0294328 A1 Dec. 3, 2009

(51) Int. Cl.
*C10G 1/04* (2006.01)

(52) U.S. Cl. ..... 208/86; 208/309; 208/45; 208/67

(58) Field of Classification Search ..... 208/309, 208/86, 45; 48/71
See application file for complete search history.

(56) References Cited

U.S. PATENT DOCUMENTS

| | | | | |
|---|---|---|---|---|
| 4,400,181 | A * | 8/1983 | Snell et al. | 48/197 R |
| 4,797,262 | A | 1/1989 | Dewitz | |
| 4,938,862 | A | 7/1990 | Visser et al. | |
| 5,447,702 | A | 9/1995 | Campbell et al. | |
| 5,578,093 | A | 11/1996 | Campbell et al. | |
| 5,663,473 | A | 9/1997 | Griffiths et al. | |
| 5,958,365 | A | 9/1999 | Liu | |
| 5,972,206 | A | 10/1999 | Lenglet et al. | |
| 5,976,361 | A | 11/1999 | Hood et al. | |
| 6,156,809 | A * | 12/2000 | Clark et al. | 518/719 |
| 6,171,473 | B1 | 1/2001 | Fornoff | |
| 6,183,627 | B1 | 2/2001 | Friday et al. | |
| 6,241,874 | B1 * | 6/2001 | Wallace et al. | 208/309 |
| 6,274,003 | B1 | 8/2001 | Friday et al. | |
| 6,274,030 | B1 | 8/2001 | Wallace et al. | |
| 6,274,032 | B2 | 8/2001 | Hood et al. | |
| 6,361,682 | B1 | 3/2002 | Moretta et al. | |
| 6,409,912 | B1 | 6/2002 | Wallace et al. | |
| 6,533,925 | B1 | 3/2003 | Wallace et al. | |
| 6,673,234 | B2 | 1/2004 | Li et al. | |

(Continued)

FOREIGN PATENT DOCUMENTS

EP 0634470 A1 1/1995

OTHER PUBLICATIONS

Smith, Peter V. et al., KBR Transport Gasifier, Gasification Technologies 2005, Oct. 9-12, 2005, pp. 1-10, San Francisco, California, USA.

(Continued)

*Primary Examiner* — Glenn A Caldarola
*Assistant Examiner* — Michelle L Stein

(57) ABSTRACT

Systems and methods for processing hydrocarbons are provided. A hydrocarbon containing one or more asphaltenes and one or more non-asphaltenes can be mixed with a solvent. The ratio of the solvent to the hydrocarbon can be about 2:1 to about 10:1. The asphaltenes can be selectively separated from the non-asphaltenes. A portion of the asphaltenes can be vaporized in the presence of gasified hydrocarbons and combustion gas. A portion of the asphaltenes can be cracked at a temperature sufficient to provide a cracked gas. Liquid asphaltenes, solid asphaltenes, or both can be deposited onto one or more solids to provide one or more hydrocarbon containing solids. The cracked gas can be selectively separated from the hydrocarbon containing solids. A portion of the hydrocarbon containing solids can be combusted to provide the combustion gas. The hydrocarbon containing solids can be gasified to provide the gasified hydrocarbons and to regenerate the solids.

20 Claims, 7 Drawing Sheets

U.S. PATENT DOCUMENTS

| | | | |
|---|---|---|---|
| 6,702,936 | B2 | 3/2004 | Rettger et al. |
| 6,773,630 | B2 | 8/2004 | Stellaccio et al. |
| 6,974,842 | B1 | 12/2005 | Spena et al. |
| 2004/0118745 | A1 | 6/2004 | Rettger et al. |
| 2005/0183989 | A1 | 8/2005 | Christensen |
| 2006/0042999 | A1 | 3/2006 | Iqbal et al. |
| 2006/0157385 | A1 | 7/2006 | Montanari et al. |
| 2006/0272982 | A1 | 12/2006 | Montanari et al. |
| 2006/0283776 | A1 | 12/2006 | Iqbal et al. |
| 2007/0007168 | A1 * | 1/2007 | Zhao et al. ..... 208/45 |
| 2007/0144944 | A1 | 6/2007 | Del Bianco et al. |

OTHER PUBLICATIONS

Wallace, Paul S. et al., Heavy Oil Upgrading by the Separation and Gasification of Asphaltenes, Gasification Technologies Conference, Oct. 1998, pp. 1-11, San Francisco, California, USA.

* cited by examiner

INTEGRATED SOLVENT DEASPHALTING AND GASIFICATION

BACKGROUND

1. Field

The present embodiments generally relate to systems and methods for deasphalting hydrocarbons and upgrading products therefrom. More particularly, embodiments of the present invention relate to systems and methods for upgrading asphaltenes using gasification.

2. Description of the Related Art

Solvent de-asphalting ("SDA") processes have been used to treat heavy hydrocarbons. Traditional refinery distillation processes separate light hydrocarbon compounds from incoming feedstocks, leaving a large volume of residuum ("residual oil") that is primarily heavy hydrocarbons. SDA processes have been used to treat the heavy hydrocarbons with a solvent to generate asphaltene and de-asphalted oil ("DAO") products. The asphaltene and DAO products are typically treated and/or processed into useful products.

One upgrading method for the asphaltene product is gasification. Gasification of the asphaltene product produces a synthesis gas ("syngas") which is primarily hydrogen, carbon monoxide, carbon dioxide, and water. Typical gasification techniques used prevent potentially more valuable lighter hydrocarbons (e.g. $C_2$-$C_{20}$) from being recovered from the asphaltene product as gasification converts the hydrocarbon compounds which make up the asphaltene product to syngas, rather than more valuable lighter hydrocarbons.

Thus, a need exists for improved systems and methods for upgrading asphaltenes using gasification.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
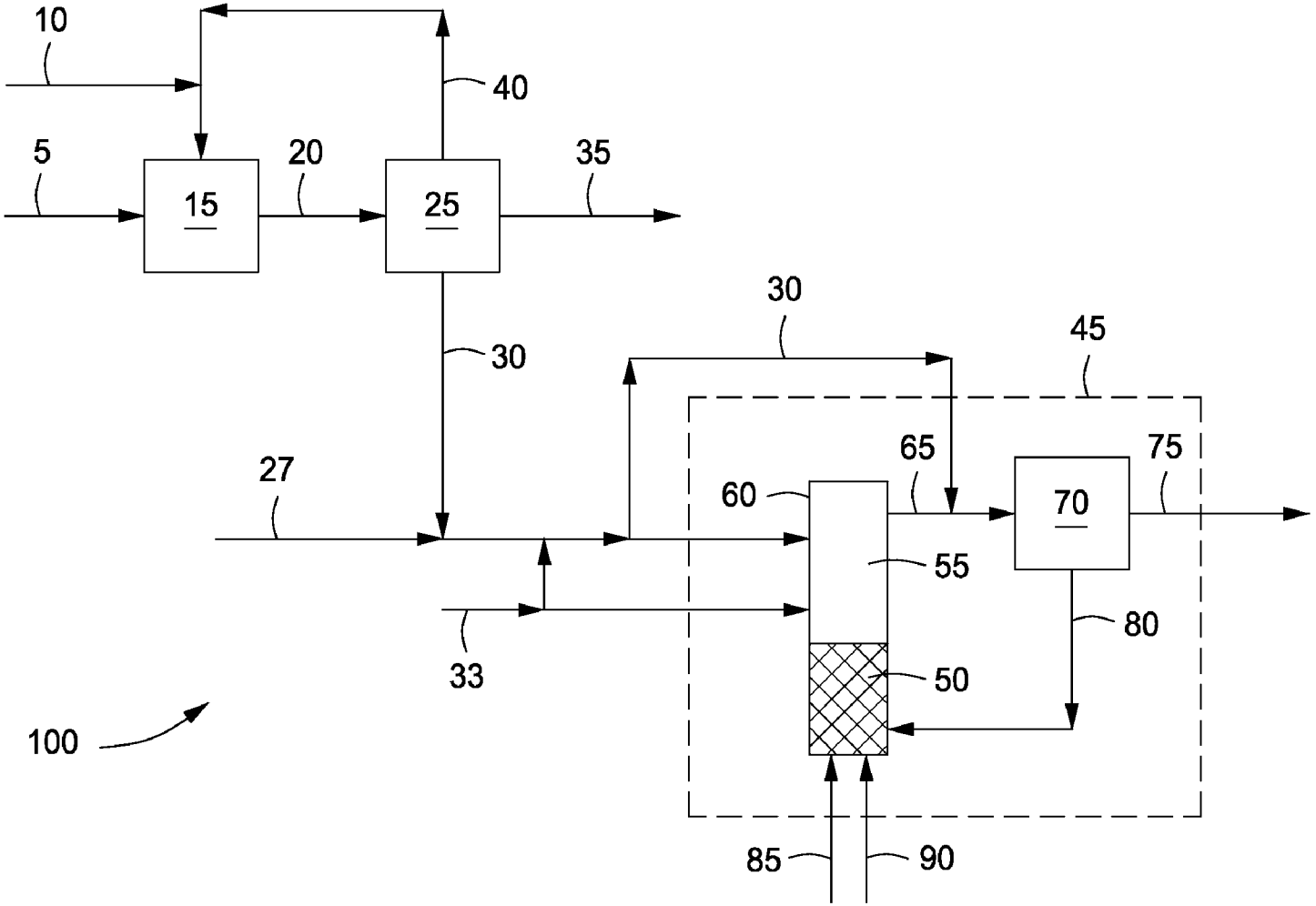
FIG. 1 depicts an illustrative integrated solvent deasphalting and gasification system, according to one or more embodiments described.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Systems and methods for processing hydrocarbons are provided. In one or more embodiments, a hydrocarbon containing one or more asphaltenes and one or more non-asphaltenes can be mixed with a solvent. In one or more embodiments, the hydrocarbon can have a specific gravity of from about 6° API to about 25° API, as measured according to ASTM D4052 at 15.6° C. In one or more embodiments, the ratio of the solvent to the hydrocarbon can be about 2:1 to about 10:1. In one or more embodiments, the asphaltenes can be selectively separated from the non-asphaltenes. In one or more embodiments, a portion of the asphaltenes can be vaporized in the presence of gasified hydrocarbons and combustion gas. In one or more embodiments, a portion of the asphaltenes can be cracked at a temperature sufficient to provide a cracked gas. In one or more embodiments, the cracked gas can include more than 0.5% vol $C_1$-$C_3$ hydrocarbons, more than 0.5% vol $C_4$-$C_6$ hydrocarbons, and more than 1% vol $C_7$-$C_9$ hydrocarbons. In one or more embodiments, liquid asphaltenes, solid asphaltenes, or both can be deposited onto one or more solids to provide one or more hydrocarbon containing solids. In one or more embodiments, the cracked gas can be selectively separated from the hydrocarbon containing solids. In one or more embodiments, a portion of the hydrocarbon containing solids can be combusted to provide the combustion gas. In one or more embodiments, the hydrocarbon containing solids can be gasified to provide the gasified hydrocarbons and to regenerate the solids.

The term "asphaltenes" as used herein refers to a hydrocarbon or mixture of hydrocarbons that are insoluble in n-alkanes such as n-heptane or n-pentane, yet are totally or partially soluble in aromatics such as benzene or toluene. Hydrocarbons that can be classified as asphaltenes include a broad distribution of molecular structures that can vary greatly from one hydrocarbon source to another.

The term "non-asphaltene" as used herein refers to a hydrocarbon or mixture of hydrocarbons that are soluble in n-alkanes, yet are totally or partially insoluble in aromatics such as benzene or toluene.

FIG. 1 depicts an illustrative integrated solvent deasphalting and gasification system 100, according to one or more embodiments. The integrated solvent deasphalting and gasification system 100 can include one or more mixers 15, one or more separator/solvent extraction systems 25, and one or more gasifiers 45. The gasifier 45 can include one or more oxidation ("combustion") zones 50, and one or more oxygen depleted zones 55 disposed within one or more risers 60. The gasifier 45 can further include one or more transition lines 65, one or more separators 70, and one or more recycle lines 80. The one or more transition lines 65 can be an oxygen depleted zone.

In one or more embodiments, a hydrocarbon, which can include, but is not limited to, one or more asphaltenes and one or more non-asphaltene hydrocarbons or non-asphaltenes can be introduced via line 5 to the one or more mixers 15. The one or more mixers 15 can mix or otherwise combine the hydrocarbon with solvent introduced via line 40 and/or 10 to provide a mixture via line 20. The asphaltenes can then be separated from the non-asphaltene hydrocarbons and solvent to provide separated asphaltenes ("asphaltene-rich mixture") via line 30 and a deasphalted oil ("DAO") mixture via line 35. The asphaltene-rich mixture can include, but is not limited to, the asphaltenes and a first portion of the solvent. The DAO mixture can include, but is not limited to, the non-asphaltenes and a second portion of the solvent. The solvent can be separated from the asphaltene-rich mixture and/or the DAO mixture, and recycled via line 40 to the one or more mixers 15.

In one or more embodiments, the asphaltenes in the asphaltene-rich mixture can have an API Gravity at 15.6° C. (60° F.) of less than 10, less than 5, less than 0, less than −2, or less than −5. In one or more embodiments, the asphaltene-rich mixture can have an API Gravity at 15.6° C. (60° F.) of from about −9 to about 9, or from about −9 to about 0, or from about −9 to about −5. In one or more embodiments, the asphaltenes in the asphaltene-rich mixture can have a specific gravity at 15.6° C. (60° F.) of from about 1.007 to about 1.1550, or from about 1.037 to about 1.149, or from about 1.068 to about 1.149. In one or more embodiments, the asphaltene-rich mixture in line 30 can be liquid.

In one or more embodiments, the asphaltenes in the asphaltene-rich mixture can include from about 15% wt to about 45% wt Conradson Carbon Residu ("CCR"), or from about 35% wt to about 41% wt CCR, or from about 37% wt to about 39% wt CCR. In one or more embodiments, the asphaltenes in the asphaltene-rich mixture can include about 10 ppm by wt Nickel ("Ni") or more, or about 70 ppm by wt Ni or more, or about 140 ppm by wt Ni or more, or about 180 ppm by wt Ni or more, or about 220 ppm by wt Ni or more. In one or more embodiments, the asphaltenes in the asphaltene-rich mixture can include about 20 ppm by wt Vanadium or more, or about 100 ppm by wt Vanadium or more, or about 300 ppm by wt Vanadium or more, or abut 700 ppm by wt Vanadium or more. In one or more embodiments, the asphaltenes in the asphaltene-rich mixture can include about 0.5% wt Nitrogen ($N_2$) or more, about 0.8% wt $N_2$ or more, about 1.0% wt $N_2$ or more, or about 1.1% wt $N_2$ or more. In one or more embodiments, the asphaltenes in the asphaltene-rich mixture can include about 1.8% wt Sulfur or more, about 2.2% wt Sulfur or more, about 2.5% wt Sulfur or more, or about 2.7% wt Sulfur or more. In one or more embodiments, the asphaltenes in the asphaltene-rich mixture can have a carbon to hydrogen (C:H) ratio of from about 0.7:1, about 1:1, about 1:1.1, about 1:1.2, about 1:1.3, or about 1:1.4. In one or more embodiments, the asphaltenes in the asphaltene-rich mixture can include about 0.001% to about 30% of the solvent or from about 5% to about 20% of the solvent. In one or more embodiments, the asphaltene-rich mixture can include from about 10% to about 20% of the total solvent introduced to the one or more mixers 15.

In one or more embodiments, the asphaltene-rich mixture via line 30 with or without an oxygen scavenger, sorbent, and/or carrier fluid (introduced via line 33) can be introduced to the one or more gasifiers 45 to provide a product gas via line 75. In one or more embodiments, the asphaltene-rich mixture via line 30 can be introduced to one or more oxygen depleted zones 55 downstream of the one or more combustion zones 50. In one or more embodiments, the asphaltene-rich mixture via line 30 can be introduced to the transition line 65. In one or more embodiments, the asphaltene-rich mixture via line 30 can be introduced to the oxygen depleted zone 55 and/or the transition line 65.

In one or more embodiments, the product gas in line 75 can include, but is not limited to hydrocarbon gases. The hydrocarbon gases can include, for example, methane, ethane, propane, butane, pentane, hexane, and other $C_1$ to $C_{20}$ hydrocarbons, and synthesis gas ("syngas") (e.g. hydrogen, carbon monoxide, and carbon dioxide). The hydrocarbon gases can be produced by vaporizing and/or cracking at least portion of the hydrocarbons present in the asphaltene-rich mixture within the oxygen depleted zone 55 and/or the transition line 65. In one or more embodiments, non-vaporized and non-cracked hydrocarbons can be deposited onto solids or transport media to provide coked-solids ("hydrocarbon containing solids"). The non-vaporized and non-cracked hydrocarbons can be a solid, a liquid, or both. The syngas can be produced by recycling via line 80 the coked-solids to the one or more combustion zones 50, wherein the hydrocarbons can be partially combusted to provide heat and partially gasified to provide the syngas.

In one or more embodiments, the product gas in line 75 can include, but is not limited to hydrogen, carbon monoxide, carbon dioxide, water, one or more hydrocarbons, and one or more coke-covered solids. In one or more embodiments, the $C_1$-$C_3$ concentration in the product gas can range from about 5% vol to about 95% vol, about 10% vol to about 90% vol, about 20% vol to about 80% vol, about 30% vol to about 70% vol, or about 30% vol to about 60% vol. In one or more embodiments, the $C_4$-$C_6$ concentration in the gasified mixture in the product gas can range from about 5% vol to about 95% vol, about 10% vol to about 90% vol, about 20% vol to about 80% vol, about 30% vol to about 70% vol, or about 30% vol, to about 60% vol. In one or more embodiments, the $C_7$-$C_9$ concentration in the gasified mixture in the product gas can range from about 1% vol, to about 50% vol, about 2% vol to about 45% vol, about 3% vol to about 40% vol, about 4% vol to about 35% vol, or about 5% vol to about 30% vol. In one or more embodiments, the $C_{10}$-$C_{12}$ concentration in the product gas can range from about 1% vol to about 40% vol, about 2% vol to about 35% vol, about 3% vol to about 30% vol, about 4% vol to about 25% vol, or about 5% vol to about 20% vol. In one or more embodiments, the $C_{12}$+ concentration in the product gas can range from about 1% vol to about 20% vol, about 1% vol to about 15% vol, about 1% vol to about 10% vol, about 1% vol to about 7% vol, or about 1% vol to about 5% vol. In one or more embodiments, the carbon monoxide concentration in the product gas can range from about 1% vol to about 50% vol, about 2% vol to about 45% vol, about 3% vol to about 40% vol, about 4% vol to about 35% vol, or about 5% vol to about 30% vol. In one or more embodiments, the carbon dioxide concentration in the product gas can range from about 1% vol to about 50% vol, about 2% vol to about 45% vol, about 3% vol to about 40% vol, about 4% vol to about 35% vol, or about 5% vol to about 30% vol.

In one or more embodiments, the hydrocarbon in line 5 can include, but is not limited to, one or more carbon-containing materials. The carbon-containing materials can include but are not limited to, whole crude oil, crude oil, oil shales, oil sands, tars, bitumens, kerogen, derivatives thereof, or mixtures thereof. In one or more embodiments, the hydrocarbon feed can be or include one or more asphaltenes. The hydrocarbon via line 5 can include one or more asphaltenes and one or more hydrocarbons, i.e. non-asphaltene hydrocarbons. In one or more embodiments, the hydrocarbon via line 5 can include water.

In one or more embodiments, the hydrocarbon via line 5 can include one more hydrocarbons, having an API@15.6° C. (ASTM D4052) of less than 35, less than 25, less than 20, less than 15, or less than 10. In one or more embodiments, the API can range from a low of about 6, 8, or 10 to a high of about 15, 25, or 30. In one or more embodiments, the hydrocarbon via line 5 can include one or more hydrocarbons having a normal, atmospheric, boiling point of less than about 1,090° C., less than about 1,080° C., less than about 1,050° C., or less than about 1,000° C.

In one or more embodiments, the solvent can be any solvent that can differentiate the density of the non-asphaltene hydrocarbons and the asphaltenes to facilitate a phase separation therebetween. Suitable solvents can include, but are not limited to, aliphatic hydrocarbons, cycloaliphatic hydrocarbons, aromatic hydrocarbons, and mixtures thereof. In one or more embodiments, the solvent can include propane, butane, pentane, benzene, or mixtures thereof. In one or more embodiments, the solvent can include at least 90% wt, at least 95% wt, or at least 99% wt of one or more hydrocarbons having a normal boiling point below 538° C. (1,000° F.). In one or more embodiments, the solvent can include one or more gas condensates having a boiling range of about 27° C. (81° F.) to about 121° C. (250° F.); one or more light naphthas having a boiling range of about 32° C. (90° F.) to about 82° C. (180° F.); one or more heavy naphthas having a boiling range of about 82° C. (180° F.) to about 221° C. (430° F.); or mixtures thereof. In one or more embodiments, the solvent can be or include alkanes having between three and five ($C_3$-$C_5$) carbon atoms. In one or more embodiments, the solvent can include 80% wt or more propane, butanes, pentanes, or mixtures thereof.

In one or more embodiments, the solvent can have a critical temperature of about 90° C. (194° F.) to about 538° C. (1,000° F.); about 90° C. (194° F.) to about 400° C. (752° F.); or about 90° C. (194° F.) to about 300° C. (572° F.). In one or more embodiments, the solvent can have a critical pressure of about 2,000 kPa (276 psig) to about 6,000 kPa (856 psig); about 2,300 kPa (319 psig) to about 5,800 kPa (827 psig); or about 2,600 kPa (363 psig) to about 5,600 kPa (798 psig). In one or more embodiments, the solvent in lines 10 and/or 40 can be partially or completely vaporized. In one or more embodiments, the solvent in lines 10 and/or 40 can be greater than about 50% wt vapor; greater than about 75% wt vapor; greater than about 90% wt vapor; or greater than about 95% wt vapor with the balance liquid solvent.

In one or more embodiments, the mixture in line 20 can have a ratio of solvent to hydrocarbon of about 1:1 to about 100:1, about 2:1 to about 50:1, about 2:1 to about 10:1, or about 3:1 to about 6:1. In one or more embodiments, the mixture in line 20 can have a ratio of solvent to hydrocarbon ranging from a low of about 1:1, about 2:1, or about 3:1 to a high of about 10:1, about 15:1, or about 20:1. The concentration of the solvent in the mixture can range from about 50% wt to about 99% wt; 60% wt to about 95% wt; or about 66% wt to about 86% wt with the balance the hydrocarbon. The concentration of the hydrocarbon in the mixture can range from about 1% wt to about 50% wt, from about 5% wt to about 40% wt, or from about 14% wt to about 34% wt with the balance solvent.

In one or more embodiments, the asphaltene concentration of the asphaltene-rich mixture in line 30 can range from about 10% wt to about 99% wt; about 30% wt to about 95% wt; or about 50% wt to about 90% wt. In one or more embodiments, the asphaltene-rich mixture in line 30 can range from a low of about 40% wt, about 50% wt, or about 60% wt to a high of about 80% wt, about 90% wt, or about 95% wt. In one or more embodiments, the solvent concentration in the asphaltene-rich mixture in line 30 can range from about 1% wt to about 90% wt; about 5% wt to about 70% wt; or about 10% wt to about 50% wt.

The mixture via line 20 can be introduced to the one or more separator/solvent extraction systems 25 to provide the asphaltene-rich mixture via line 30, the DAO mixture via line 35, and a recovered solvent via line 40. In one or more embodiments, the one or more separator/solvent extraction systems 25 can operate at sub-critical, critical, or supercritical temperatures and/or pressures with respect to the solvent to permit separation of the asphaltenes from the oil. The recovered solvent can be recycled via line 40 to the one or more mixers 15. Make-up or supplemental solvent can be introduced via line 10 to the one or more mixers 15. As will be discussed and described in more detail below, the DAO can be further processed to provide a heavy deasphalted oil ("HDAO") and light deasphalted oil ("LDAO") via line 35.

In one or more embodiments, the asphaltene-rich mixture in line 30 can be fluidized and introduced to the gasifier 45. In one or more embodiments, the asphaltene-rich mixture in line 30 can be heated to a temperature and/or pressure sufficient to fluidize the asphaltene-rich mixture. The asphaltene-rich mixture can have a viscosity at 15.6° C. (60° F.) ranging from a low of from about 0.8 cP, about 100 cP, or about 1,000 cP to a high of about 10,000 cP, about 100,000 cP, or about 2 million cP or more. The temperature of the asphaltene-rich mixture can range from a low of from about −7° C. (−45° F.), about 10° C. (50° F.), or about 20° C. (68° F.) to a high of about 40° C. (104° F.), about 65° C. (149° F.), or about 90° C. (194° F.) or more. The asphaltene-rich mixture can be at a pressure ranging from a low of from about 100 kPa (0 psig), about 500 kPa (58 psig), or about 5,000 kPa (710 psig) to a high of about 10,000 kPa (1,435 psig), about 25,000 kPa (3,615 psig), or about 50,000 kPa (7,235 psig) or more.

In one or more embodiments, the asphaltene-rich mixture via line 30 can be introduced to the gasifier 45 as a slurry or suspension using a carrier fluid introduced via line 33. Illustrative carrier fluids via line 30 can include, but are not limited to, air, nitrogen, carbon dioxide, carbon monoxide, syngas, hydrogen, steam, nitrogen free gas, low oxygen gas, oxygen-free gas, or and combination thereof. In one or more embodiments, the asphaltene-rich mixture via line 30 can be introduced to the gasifier directly without a carrier fluid. In one or more embodiments, the asphaltene-rich mixture can be dried, for example to 18% moisture, and then pulverized by milling units such as one or more parallel bowl mills prior to introducing to the gasifier 45. For example, the asphaltene-rich mixture can be reduced to an average particle diameter size of from about 50 μm to about 500 μm; about 50 μm to about 400 μm; about 150 μm to about 450 μm; or about 250 μm to about 400 μm. The carrier fluid and/or sorbents via line 33 can be added to the asphaltene-rich mixture in line 30 either before or after reducing the asphaltene-rich mixture particle size.

In one or more embodiments, one or more oxygen scavengers and/or sorbents via line 33 can be added to the asphaltene-rich mixture in line 30 and/or the gasifier 45 to limit the oxygen concentration to levels below the threshold required to support uncontrolled reactions with hydrogen. The sorbents can be added to capture contaminants from the syngas, such as sodium vapor in the gas phase within the gasifier 45. The oxygen scavenger can include an ash containing reactive carbon which, by reacting to form carbon monoxide and/or carbon dioxide, can chemically bond with residual oxygen present in the gasifier 45. The sorbents can be used to dust or coat the asphaltene-rich mixture prior to introduction to the gasifier 45 to reduce agglomeration of the asphaltene-rich mixture within line 30 and within the gasifier 45. In one or more embodiments, the sorbents can be ground to an average particle size of about 5 μm to about 100 μm, or about 10 μm to about 75 μm prior to mixing with the asphaltene-rich mixture in line 30 or introduction directly to the gasifier 45. Illustrative sorbents can include, but are not limited to, carbon rich ash, limestone, dolomite, and coke breeze, and mixtures thereof. Residual sulfur released from the asphaltene-rich mixture can be captured by native calcium in the feed or by a calcium-based sorbent to form calcium sulfide.

In one or more embodiments, one or more carbonaceous materials via line 27 can be introduced to the asphaltene-rich mixture in line 30 prior to introducing the asphaltene-rich mixture to the gasifier 45. Although not shown, in one or more embodiments, the carbonaceous material via line 27 can be independently (i.e. separately) introduced to the gasifier 45. In one or more embodiments, the carbonaceous material can include, but is not limited to, any carbon-containing material. Illustrative carbon-containing material can include, can include, but are not limited to, biomass (i.e., plant and/or animal matter or plant and/or animal derived matter); coal (high-sodium and low-sodium lignite, lignite, subbituminous, and/or anthracite, for example); oil shale; coke; tar; asphaltenes; low ash or no ash polymers; hydrocarbon-based polymeric materials; biomass derived material; or by-product(s) derived from manufacturing operations. The hydrocarbon-based polymeric materials can include, for example, thermoplastics, elastomers, rubbers, including polypropylenes, polyethylenes, polystyrenes, including other polyolefins, homo polymers, copolymers, block copolymers, and blends thereof; PET (polyethylene terephthalate), poly blends, poly-hydrocarbons containing oxygen; heavy hydrocarbon sludge and bottoms products from petroleum refineries and petrochemical plants such as hydrocarbon waxes, blends thereof, derivatives thereof, and combinations thereof.

In one or more embodiments, the carbonaceous material can include a mixture or combination of two or more carbonaceous materials. In one or more embodiments, the carbonaceous material can include a mixture or combination of two or more low ash or no ash polymers, biomass derived materials, or by-products derived from manufacturing operations. In one or more embodiments, the carbonaceous material can include one or more carbonaceous materials combined with one or more discarded hydrocarbon-based consumer products, such as carpet and/or plastic automotive parts/components including bumpers and dashboards. Such discarded consumer products are preferably suitably reduced in size to fit within the gasifier 45. In one or more embodiments, the carbonaceous material can include one or more recycled plastics such as polypropylene, polyethylene, polystyrene, derivatives thereof, blends thereof, or any combination thereof Accordingly, the process can be useful for accommodating mandates for proper disposal of previously manufactured materials.

In one or more embodiments, all or a portion of the asphaltene-rich mixture via line 30 and the optionally added carbonaceous material introduced via line 27 to the asphaltene-rich mixture as shown, or introduced directly (not shown) to the gasifier 45 can be gasified. For simplicity and ease of description, embodiments one or more hydrocarbons (i.e. the asphaltene-rich mixture in line 30 and/or the additional carbonaceous materials in line 27) of the integrated solvent deasphalting and gasification system 100 will be further described in the context of the asphaltene-rich mixture. It can be understood that additional carbonaceous material via line 27 can be introduced to asphaltene-rich mixture in line 30 and/or separately to the gasifier 45.

The asphaltene-rich mixture via line 30 can be introduced downstream the combustion zone 50 in the gasifier 45. For example, the asphaltene-rich mixture via line 30 can be introduced to the oxygen depleted zone 55 and/or to the transition line 65. The transition line 65 can connect, in fluid communication, the upper portion of the riser 60 with the one or more separators 70. The light hydrocarbons present in the asphaltene-rich mixture in line 30 can vaporize ("flash") and/or crack to provide light hydrocarbon gases which can be recovered via line 75.

In one or more embodiments, the oxygen depleted zone 55 can contain less than 5%, less than 3%, less than 2%, less than 1%, or less than 0.5% of the stoichiometric amount oxygen required to oxidize the asphaltene-rich mixture. The oxygen depleted zone 55 can contain from In one or more embodiments, the oxygen depleted zone 55 can be at a pressure of from about 101 kPa (0 psig) to about 10,400 kPa (1,500 psig), about 200 kPa (15 psig) to about 9,380 kPa (1,350 psig), about 300 kPa (30 psig) to about 8,350 kPa (1,200 psig), or about 400 kPa (45 psig) to about 6,975 kPa (1,000 psig). In one or more embodiments, the oxygen depleted zone 55 can be at a temperature of from about 430° C. (806° F.) to about 1,650° C. (3,002° F.); about 510° C. (950° F.) to about 1,500° C. (2,732° F.); or about 600° C. (1,112° F.) to about 1,200° C. (2,192° F.).

The vaporizing and/or cracking of the asphaltenes and or other hydrocarbons can be controlled by adjusting the temperature and contact time of the asphaltene-rich mixture at elevated temperatures in the oxygen depleted zone 55. For example, the contact time of the asphaltene-rich mixture within oxygen depleted zone 55 can be controlled by adjusting the injection point which can span from just downstream the combustion zone 50 to the transition line 65. Longer residence or contact times can be obtained by injecting the asphaltene-rich mixture into the combustion zone 50 or the lower portion of the oxygen depleted zone 55. Shorter residence or contact times can be obtained by injecting the asphaltene-rich mixture into the transition line 65, with the shortest time occurring with injection just before the one or more separators 70. The temperature can be controlled by using a quench media, varying the carbon to oxygen ratio, adjusting the type and amount of carrier fluid, and adjusting the type and amount of oxidant. In one or more embodiments, one or more oxidants via line 85 can be introduced to the combustion zone 50. The oxidant via line 85 can include, but is not limited to, air, oxygen, essentially oxygen, oxygen-enriched air, mixtures of oxygen and air, mixtures of oxygen and inert gas such as nitrogen and argon, and combinations thereof.

In one or more embodiments, all or a portion the asphaltenes that do not gasify to provide hydrocarbon gases can be deposited onto one or more solids or transport mediums within the gasifier and returned via recycle line 80 to the combustion zone 50 and/or oxygen depleted zone 55. At least a portion of the recycled asphaltenes via line 80 can be combusted to provide the heat for the gasification reactions and/or gasified to provide syngas, which can be recovered via line 75.

In one or more embodiments, the molar oxygen concentration within the combustion zone 50 can be sub-stoichiometric based upon the molar concentration of carbon within the combustion zone 50. In one or more embodiments, the oxygen concentration within the combustion zone 50 can range from about 5% to about 90% of stoichiometric requirements, about 5% to about 75% of stoichiometric requirements, about 5% to about 60% of stoichiometric requirements, or about 5% to about 45% of stoichiometric oxygen requirements based on the molar concentration of carbon in the combustion zone 50.

In one or more embodiments, the combustion zone 50 can be at a pressure of from about 101 kPa (0 psig) to about 10,400 kPa (1,500 psig), about 200 kPa (15 psig) to about 9,380 kPa (1,350 psig), about 300 kPa (30 psig) to about 8,350 kPa (1,200 psig), or about 400 kPa (45 psig) to about 6,975 kPa (1,000 psig). In one or more embodiments, the combustion zone 50 can be at a temperature of from about 430° C. (806° F.) to about 1,650° C. (3,002° F.); about 510° C. (950° F.) to about 1,500° C. (2,732° F.); or about 600° C. (1,112° F.) to about 1,200° C. (2,192° F.).

The one or more solids or transport medium can be or include, but are not limited to, refractory oxides, such as alumina, alpha alumina, zirconia, titania, hafnia, silica, or mixtures thereof, rare earth modified refractory metal oxides, where the rare earth may be any rare earth metal (e.g. lanthanum or yttrium); alkali earth metal modified refractory oxides; ash; derivatives thereof, or mixtures thereof. The transport media can be categorized as materials having a substantially stable surface area at reaction conditions, for example, a surface area that is not substantially altered by reaction conditions, or altered in a way that affects the gasification.

In one or more embodiments, the asphaltene-rich feed via line 30 can be introduced to the oxygen depleted zone 55 at a rate of from about 500 kg/hr to about 4000 kg/hr, or from about 1,000 kg/hr to about 3,000 kg/hr, or from about 1,500 kg/hr to about 2,300 kg/hr. For example, the asphaltene-rich feed via line 30 can be introduced to the oxygen depleted zone 55 at a rate of about 1,500 kg/hr, about 1,800 kg/hr, about 2,000 kg/hr, or about 2,200 kg/hr or more. In one or more embodiments, the optional carbonaceous material via line 27 can be introduced (not shown) to the combustion zone 50, and the asphaltene-rich mixture via line 30 can be introduced (not shown) to the oxygen depleted zone 55, independently. In one or more embodiments, the carbonaceous material via line 27 can be introduced at a rate of about 500 kg/hr, about 750 kg/hr, about 1,000 kg/hr, or about 1,250 kg/hr. In one or more embodiments, the optional steam via line 90 can be introduced to the combustion zone 50, the oxygen depleted zone 55 via the carrier fluid or independently (not shown) at a total feed rate of about 300 kg/hr to about 1,000 kg/hr. For example, the steam be introduced to the gasifier 45 at a low rate of about 400 kg/hr, about 500 kg/hr, or about 600 kg/hr to a high rate of about 700 kg/hr, 800 kg/hr, or 900 kg/hr. In one or more embodiments, the recycled asphaltenes, i.e. coked-solids via line 80 can be introduced to the combustion zone 50, the oxygen depleted zone 55 (not shown), or both at a total rate of about 5,000 kg/hr to about 150,000 kg/hr. For example, the recycled asphaltenes via line 80 can be introduced to the gasifier 45 at a rate of about 30,000 kg/hr, about 60,000 kg/hr, about 90,000 kg/hr, or about 120,000 kg/hr.

Figure 2:
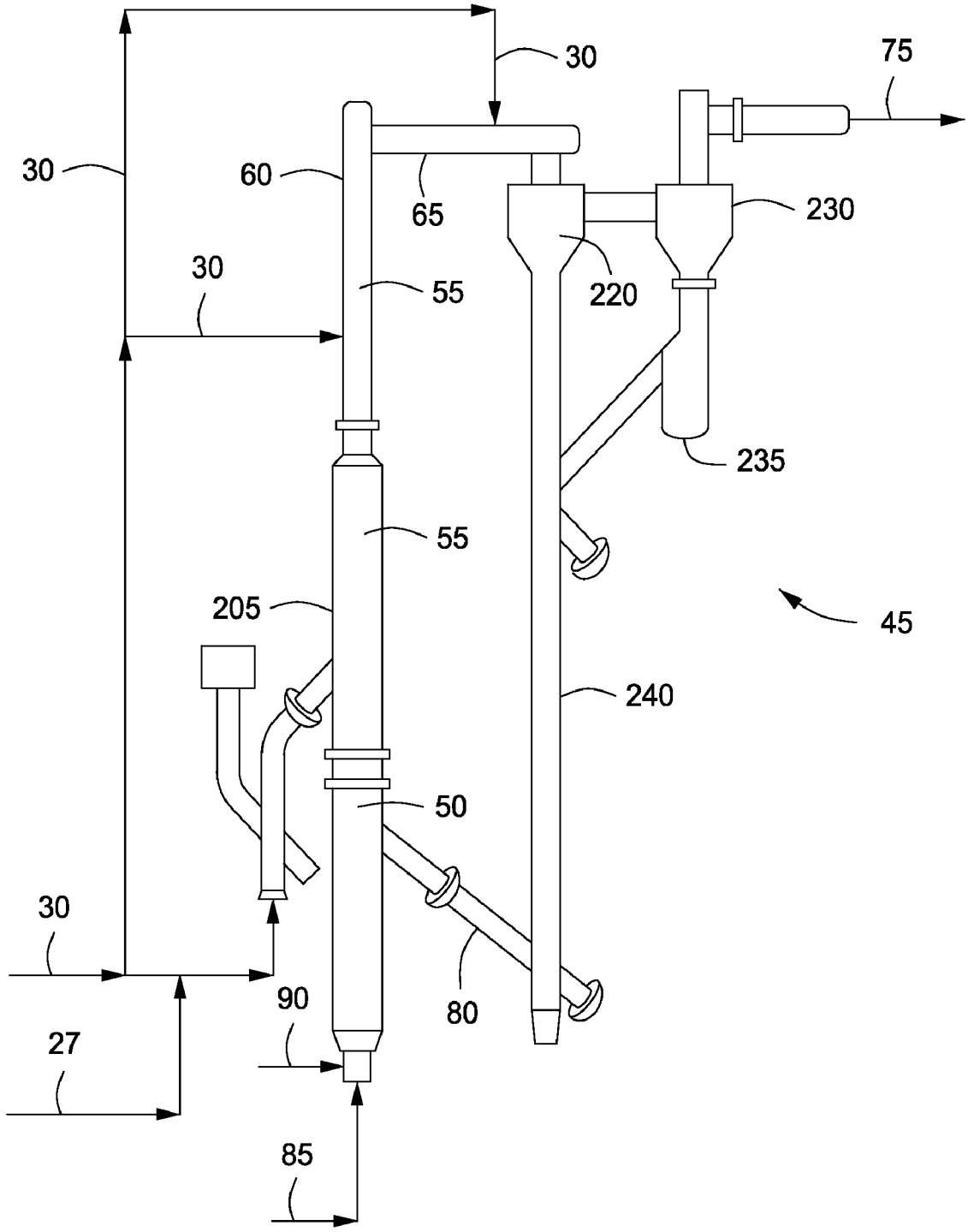
FIG. 2 depicts an illustrative gasifier for use with an integrated deasphalting and gasification system, according to one or more embodiments described.

FIG. 2 depicts an illustrative gasifier 45 for use with an integrated deasphalting and gasification system, according to one or more embodiments. The gasifier 45 can include one or more independent reactor trains arranged in series or parallel. Each independent reactor train can include one or more oxidizing zones 50, oxygen depleted zones 55, mixing zones 205, risers 60, and disengagers 220, 230. Each reactor train can be operated independently or operated where any of the one or more oxidizing zones 50, oxygen depleted zones 55, mixing zones 205, risers 60, disengagers 220, 230 can be shared. For simplicity and ease of description, embodiments of the gasifier 45 will be further described in the context of a single reactor train.

In one or more embodiments, at least a portion of the asphaltene-rich mixture via line 30 and the optional carbonaceous material via line 27 can be introduced to the oxygen depleted zone 55, riser 60, and/or transition line 65 as discussed and described in reference to FIG. 1. Although not shown, at least a portion of the asphaltene-rich mixture via line 30 and one or more oxidants via line 85 can be combined in the mixing zone 205 to provide a gas mixture, which can be combusted to provide heat. In one or more embodiments, the asphaltene-rich mixture and oxidant can be injected separately to the mixing zone 205 or mixed (not shown) prior to injection into the mixing zone 205. In one or more embodiments, the asphaltene-rich mixture and oxidant can be injected sequentially or simultaneously into the gasifier 45. Introduction of the asphaltene-rich mixture via line 30 and oxidant via line 85 to the gasifier 45 can be continuous or intermittent depending on desired product types and grades. Although not shown, the carrier fluid and/or steam via line 33 can be introduced to the asphaltene-rich mixture in line 30 or directly to the gasifier as discussed and described above in reference to FIG. 1.

In one or more embodiments, the one or more oxidants can be introduced via line 85 into the combustion zone 50 at a rate suitable to control the temperature within the oxygen depleted zone 55. The one or more oxidants can include excess air and/or nitrogen. As mentioned above, the one or more oxidants introduced to the combustion zone 50 can be sub-stoichiometric air wherein the molar ratio of oxygen to carbon within the combustion zone 50 can be maintained at a sub-stoichiometric concentration to favor the preferential formation of carbon monoxide over carbon dioxide. Excess oxygen and steam in the air supplied via line 85 can be consumed by recirculating solids within the mixing zone 205, thereby stabilizing reactor temperature during operation and during periods of feed interruption.

In one or more embodiments, the one or more oxidants can be introduced at the bottom of the mixing zone 205 to increase the temperature within the mixing zone 205 and riser 60 by combusting hydrocarbons contained deposited on the solids to form an ash ("char").

In one or more embodiments, steam via line 90 can be supplied to the combustion zone 50, and/or mixing zone 205 (not shown) to control the hydrogen to carbon monoxide ratio ($H_2$:CO) within the gasifier 45. Since the riser 60 outlet temperature can be proportionately less than comparable gasifiers (i.e. slag type), the amount of thermal heat versus chemical heat in the syngas in line 75 can be less than other gasifier designs. Thus, steam can be used to adjust by shift the $H_2$:CO ratio with a smaller energy penalty than other entrained flow gasifiers operating at higher temperatures. Because of the reduced operating temperature within the gasifier 45 (e.g. less than 1,600° C. (2,912° F.)), less energy is consumed to control and optimize the $H_2$:CO ratio, thus the production of hydrogen can be increased without a commensurate increase in steam demand within the gasifier 45. For example, the syngas leaving the gasifier 45 can have a $H_2$:CO ratio of 0.2 or more. In one or more embodiments, the $H_2$:CO ratio can be 0.5 or more. In one or more embodiments, the $H_2$:CO ratio can be about 0.25 to about 2.5; about 0.4 to about 2.0; about 0.5 to about 1.5; or about 0.8 to about 1.0.

To increase the thermal output per unit reactor cross-sectional area and to enhance energy output in any downstream power cycles (not shown) the mixing zone 205 can be operated at pressures of from about 100 kPa (0 psig) to about 4,600 kPa (653 psig). In one or more embodiments, the mixing zone 205 can be operated at a pressure from about 650 kPa (80 psig) to about 3,950 kPa (559 psig), from about 650 kPa (80 psig) to about 3,200 kPa (450 psig), or from about 650 kPa (80 psig) to about 2,550 kPa (355 psig).

In one or more embodiments, the gas mixture can exit the mixing zone 205 into the riser 60 where gasification, char gasification, methane/steam reforming, tar cracking, and water-gas shift reactions can occur simultaneously. The riser 60 can operate at a higher temperature than the mixing zone 205. In one or more embodiments, the riser 60 can have a smaller diameter than the mixing zone 205. In one or more embodiments, the superficial gas velocity in the riser 60 can range from about 3 m/s (10 ft/s) to about 27 m/s (90 ft/s), or from about 6 m/s (20 ft/s) to about 24 m/s (80 ft/s), or from about 9 m/s (30 ft/s) to about 21 m/s (70 ft/s), or from about 9 m/s (30 ft/s) to about 12 m/s (40 ft/s), or from about 11 m/s (35 ft/s) to about 18 m/s (60 ft/s). Suitable temperatures in the riser 60 can range from about 750° C. (1,382° F.) to about 1,650° C. (3,002° F.).

In one or more embodiments, the mixing zone 205 and/or riser 60 can be operated at a temperature ranging from about 500° C. (932° F.) to about 1,650° C. (3,002° F.), from about 950° C. (1,742° F.) to about 1,300° C. (2,372° F.), or from about 1,050° C. (1,922° F.) to about 1,200° C. (2,192° F.). In one or more embodiments, the mixing zone 205 and/or riser 60 can be operated in a temperature range sufficient to not melt the ash, such as from about 550° C. (1,022° F.) to about 1,050° C. (1,922° F.), or from about 275° C. (527° F.) to about 950° C. (1,742° F.). Heat can be supplied by burning the carbon in the recirculated solids in the combustion zone 50 and/or lower part of the mixing zone 205 before recirculated solids contact the entering hydrocarbons, e.g. asphaltenes and other carbonaceous material. In one or more embodiments, startup can be initiated by bringing the mixing zone 205 to a temperature of from about 500° C. (932° F.) to about 650° C. (1,202° F.) and optionally by feeding coke breeze or the equivalent to the mixing zone 205 to further increase the temperature of the mixing zone 205 to about 900° C. (1,652° F.).

In one or more embodiments, the operating temperature of the mixing zone 205 and/or riser 60 can be controlled by the recirculation rate and residence time of the solids within the riser 60, by reducing the temperature of the ash prior to recycle to the mixing zone 205, by the addition of steam to the mixing zone 205, and/or by the addition of oxidant to the mixing zone 205. The recirculating solids also can serve to rapidly heat the incoming hydrocarbons, which can also minimize tar formation. In one or more embodiments, the incoming hydrocarbons can be heated at a rate of about 500° C./s, about 750° C./s, about 1,000° C./s, about 1,250° C./s or more.

In one or more embodiments, the asphaltene-rich mixture introduced via line 30 to the oxygen depleted zone 55 and/or transition line 65 can be heated to temperatures of more than about 500° C. (932° F.), more than about 750° C. (1,382° F.), more than about 1,000° C. (1,832° F.), more than about 1,250° C. (2,282° F.), more than about 1,400° C. (2,552° F.), or more than about 1,650° C. (3,002° F.). In one or more embodiments, the temperature of the oxygen depleted zone 55 and/or the transition line 65 can range from a low of about 850° C. (1,562° F.), about 900° C. (1,652° F.), about 950° C. (1,742° F.), or about 1,000° C. (1,832° F.) to a high of about 1,350° C. (2,462° F.), about 1,450° C. (2,642° F.), about 1,550° C. (2,822° F.), or about 1,650° C. (3,002° F.). In one or more embodiments, the residence time of the hydrocarbons can be adjusted to optimize the recovery of hydrocarbons based upon the corresponding temperature within the oxygen depleted zone 55 and/or the transition line 65. For example, an oxygen depleted zone 55 operating at 1.650° C. (3,002° F.) can have a shorter residence time than an oxygen depleted zone 55 operating at 850° C. (1,562° F.). The time required for the hydrocarbons to vaporize and/or crack can be less for an oxygen depleted zone 55 operating at a high temperature, for example 1,650° C. (3,002° F.), than the time required for vaporization and/or cracking for an oxygen depleted zone 55 operating at a much lower temperature, for example, 850° C. (1,562° F.).

In one or more embodiments, the residence time of the asphaltene-rich mixture introduced via line 30 to the mixing zone 205, the oxygen depleted zone 55, and/or the transition line 65 can range from about 1 millisecond ("ms") to about 15 seconds ("s"). In one or more embodiments, the residence time of the asphaltene-rich mixture can range from a low of about 50 ms, about 100 ms, about 150 ms, or about 200 ms to a high of about 1 s, about 3 s, about 5 s, or about 8 s. The residence time of the asphaltene-rich mixture introduced via line 30 can be controlled or otherwise adjusted by introducing the asphaltene-rich mixture further downstream from the oxidizing zone 50. For example, introducing the hydrocarbon just downstream the oxidizing zone 50 can provide a longer residence time than introducing the hydrocarbon to the transition line 65. In one or more embodiments, the residence time and temperature in the mixing zone 205 and/or reaction zone 60 can be sufficient for water-gas shift reaction to reach equilibrium.

The gas mixture can exit the riser 60 and enter the one or more disengagers 220, 230 wherein the solids can be separated from the gas and recycled back to the mixing zone 205 via one or more conduits, which can include a standpipe 240, and j-leg ("recycle line") 80. Although not shown in FIG. 2, the j-leg 80 can include a non-mechanical "j-valve" to increase the effective solids residence time, increase the carbon conversion, and minimize aeration requirements for recycling solids to the combustion zone 50 and/or mixing zone 205 (not shown). In one or more embodiments, the disengagers 220, 230 can be centrifugal type separators, i.e. cyclones. In one or more embodiments, one or more solids transfer devices 235, such as a loop seal, can be located downstream of the disengagers 220, 230 to collect separated fine solids. Entrained or residual solids in the syngas, hydrocarbon vapors, and thermally cracked hydrocarbon vapors exiting the second stage disengager 230 via line 75, can be removed using one or more particulate removal systems (not shown), described and discussed below in reference to FIGS. 5-7.

In one or more embodiments, the density of the solids recycled to the combustion zone 50 and/or mixing zone 205 (not shown) via the standpipe 240 can be used to optimize the average particle diameter size of the asphaltene-rich mixture supplied to the gasifier 45 via line 30. In one or more embodiments, the carbonaceous material particle size can be varied to optimize the particulate mass circulation rate, and to improve the flow characteristics of the gas mixture within the mixing zone 205 and riser 60.

Figure 3:
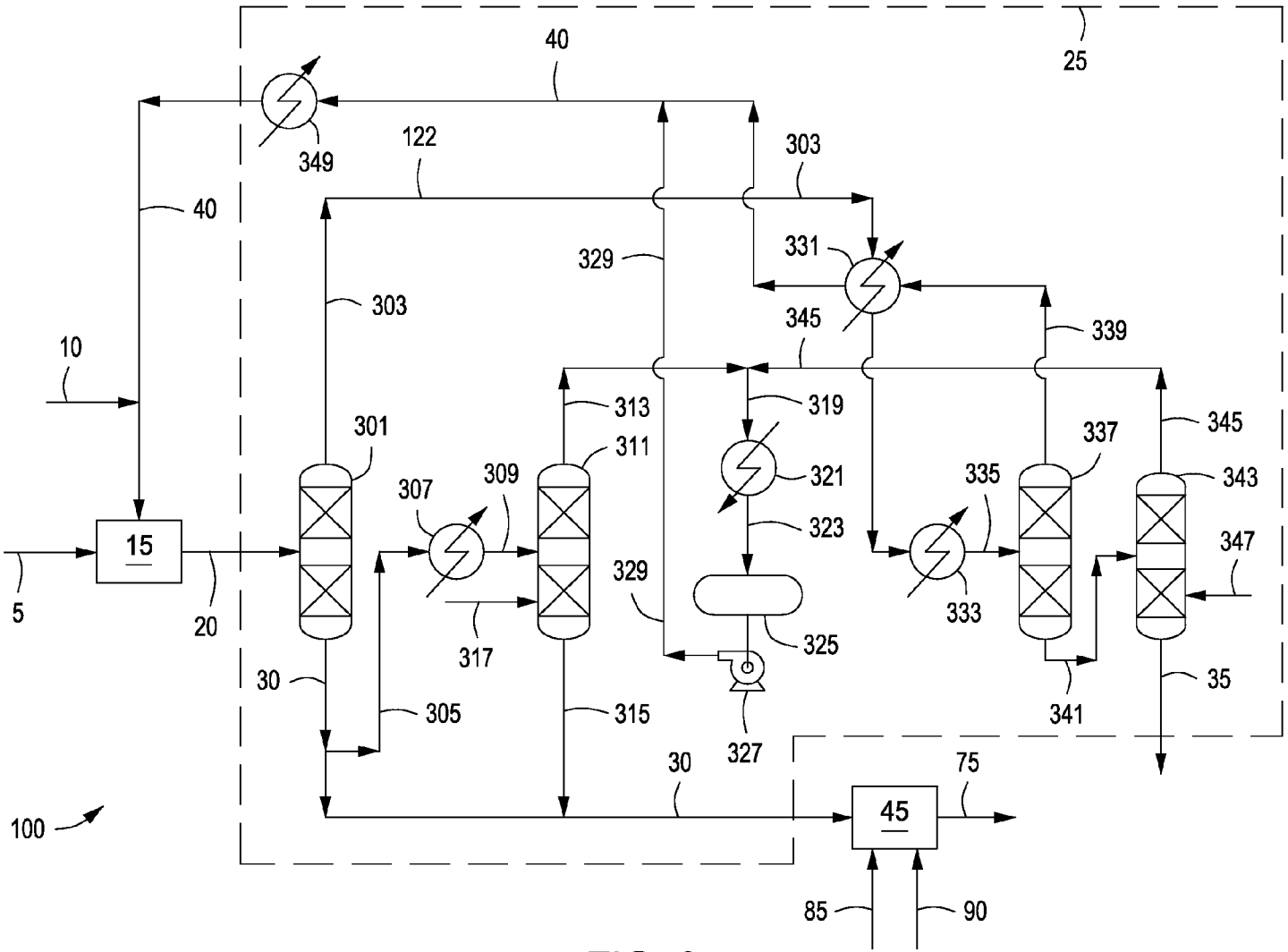
FIG. 3 depicts an illustrative separator/solvent extraction system for use with an integrated deasphalting and gasification system, according to one or more embodiments described.

FIG. 3 depicts an illustrative separator/solvent extraction system 25 for use with an integrated deasphalting and gasification system 100, according to one or more embodiments. The separator/solvent extraction system 25 can include one or more separators 301, 337, and strippers 311, 343. Any number of mixers, separators, and strippers can be used depending on the volume (amount) of the hydrocarbon feed to be processed. In one or more embodiments, the hydrocarbon feed via line 5 and solvent via line 40 and as required make-up solvent via line 10 can be mixed or otherwise combined in the one or more mixers 15 to provide the mixture via line 20. The solvent-to-hydrocarbon feed weight ratio can vary depending upon the physical properties and/or composition of the carbonaceous material. For example, a high boiling point hydrocarbon feed can require greater dilution with low boiling point solvent to obtain the desired bulk boiling point for the resultant mixture. The mixture in line 20 can have a solvent-to-hydrocarbon feed dilution ratio of about 1:1 to about 100:1; about 2:1 to about 10:1; or about 3:1 to about 6:1.

The one or more mixers 15 can be any device or system suitable for batch, intermittent, and/or continuous mixing of the hydrocarbon and solvent. The mixer 15 can be capable of homogenizing immiscible fluids. Illustrative mixers can include but are not limited to ejectors, inline static mixers, inline mechanical/power mixers, homogenizers, or combinations thereof The mixer 15 can operate at temperatures of about 25° C. (80° F.) to about 600° C. (1,112° F.); about 25° C. (77° F.) to about 500° C. (932° F.); or about 25° C. (77° F.) to about 300° C. (572° F.). The mixer 15 can operate at pressures of about 100 kPa (0 psig) to about 2,800 kPa (392 psig); about 100 kPa (0 psig) to about 1,400 kPa (189 psig); or about 100 kPa (0 psig) to about 700 kPa (87 psig).

The hydrocarbon mixture in line 20 can be introduced to the one or more separators ("asphaltene separators") 301 to provide an overhead via line 303 and the mixture ("bottoms") via line 30. The overhead in line 303 can contain DAO and a first portion of the solvent. The mixture in line 30 can contain insoluble asphaltenes and the balance of the solvent. The mixture in line 30 can also contain a minor portion of the non-asphaltene hydrocarbons. In one or more embodiments, the DAO concentration in line 303 can range from about 1% wt to about 50% wt; about 5% wt to about 40% wt; or about 14% wt to about 34% wt. In one or more embodiments, the solvent concentration in line 303 can range from about 50% wt to about 99% wt; about 60% wt to about 95% wt; or about 66% wt to about 86% wt. In one or more embodiments, the density (API@15.6° C. (60° F.)) of the overhead in line 303 can range from about 10° API to about 100° API; from about 30° API to about 100° API; or from about 50° API to about 100° API.

The one or more separators 301 can be any system or device suitable for separating one or more asphaltenes from the hydrocarbon feed and solvent mixture to provide the overhead via line 303 and the mixture via line 30. The separator 301 can include bubble trays, packing elements such as rings or saddles, structured packing, or combinations thereof. In one or more embodiments, the separator 301 can be an open column without internals. In one or more embodiments, the separators 301 can operate at a temperature of about 15° C. (59° F.) to about 150° C. (302° F.) above the critical temperature of the solvent ("$T_{C,S}$"); about 15° C. (59° F.) to about $T_{C,S}$+100° C. ($T_{C,S}$+212° F.); or about 15° C. (59° F.) to about $T_{C,S}$+50° C. ($T_{C,S}$+122° F.). In one or more embodiments, the separators 301 can operate at a pressure of about 100 kPa (0 psig) to about 700 kPa (87 psig) above the critical pressure of the solvent ("$P_{C,S}$"); about $P_{C,S}$−700 kPa ($P_{C,S}$−87 psig) to about $P_{C,S}$+700 kPa ($P_{C,S}$+87 psig); or about $P_{C,S}$−300 kPa ($P_{C,S}$−29 psig) to about $P_{C,S}$+300 kPa ($P_{C,S}$+29 psig).

In one or more embodiments, all or a portion of the mixture in line 30 via line 305 can be can be heated using one or more heat exchangers 307, and introduced via line 309 to one or more strippers 311. The one or more strippers 311 can selectively separate the mixture to provide an overhead via line 313 and a bottoms via line 315. In one or more embodiments, the overhead via line 313 can contain a first portion of solvent, and the bottoms 315 can contain a mixture of insoluble asphaltenes and a second portion of the solvent. In one or more embodiments, steam can be added via line 317 to the stripper 311 to enhance the separation of the solvent from the mixture. In one or more embodiments, the steam in line 317 can be at a pressure ranging from about 200 kPa (15 psig) to about 2,160 kPa (298 psig); from about 300 kPa (29 psig) to about 1,475 kPa (199 psig); or from about 400 kPa (44 psig) to about 1,130 kPa (149 psig). In one or more embodiments, the mixture in line 305 can be heated to a temperature of about 100° C. (212° F.) to about $T_{C,S}$+150° C. ($T_{C,S}$+302° F.); about 150° C. (302° F.) to about $T_{C,S}$+100° C. ($T_{C,S}$+212° F.); or about 300° C. (572° F.) to about $T_{C,S}$+50° C. ($T_{C,S}$+122° F.) using the one or more heat exchangers 307. In one or more embodiments, the solvent concentration in the overhead in line 313 can range from about 70% wt to about 99% wt; or about 85% wt to about 99% wt.

In one or more embodiments, the solvent concentration in the bottoms in line 315 can range from about 1% wt to about 30% wt; about 1% wt to about 20% wt; or about 1% wt to about 10% wt. In one or more embodiments, the asphaltene concentration in the bottoms 315 can range from about 20% wt to about 95% wt; about 40% wt to about 95% wt; or about 50% wt to about 95% wt. In one or more embodiments, the specific gravity at 15.6° C. (60° F.) of the bottoms 315 can range from about 5° API to about 30° API; about 5° API to about 23° API; or about 5° API to about 15° API. In one or more embodiments, at least a portion of the bottoms in line 315 can be further processed, e.g. dried and/or pelletized to provide a solid hydrocarbon product (not shown). In one or more embodiments, at least a portion of the bottoms in line 315 can be subjected to further processing, including but not limited to gasification, power generation, process heating, or combinations thereof. In one or more embodiments, at least a portion of the bottoms in line 315 can be can be introduced to line 30 and sent to the gasifier 45 to produce vaporized and/or cracked hydrocarbons, and syngas via line 75. In one or more embodiments, all of the mixture in line 30 can be introduced via line 305 to the one or more strippers 311. In one or more embodiments, at least a portion of the bottoms 315 can be used as fuel to produce steam and/or power.

The one or more heat exchangers 307 can include any system or device suitable for increasing the temperature of the mixture in line 305. Illustrative heat exchangers, systems, or devices can include, but are not limited to, shell-and-tube, plate and frame, or spiral wound heat exchanger designs. In one or more embodiments, a heating medium such as steam, hot oil, hot process fluids, electric resistance heat, hot waste fluids, or combinations thereof can be used to transfer the necessary heat to the mixture in line 305. In one or more embodiments, the one or more heat exchangers 307 can be a direct fired heater or the equivalent. In one or more embodiments, the one or more heat exchangers 307 can operate at a temperature of about 25° C. (77° F.) to about $T_{C,S}$+150° C. ($T_{C,S}$+302° F.); about 25° C. (77° F.) to about $T_{C,S}$+100° C. ($T_{C,S}$+212° F.); or about 25° C. (77° F.) to about $T_{C,S}$+50° C. ($T_{C,S}$+122° F.). In one or more embodiments, the one or more heat exchangers 307 can operate at a pressure of about 100 kPa (0 psig) to about $P_{C,S}$+700 kPa ($P_{C,S}$+87 psig); about 100 kPa (0 psig) to about $P_{C,S}$+500 kPa ($P_{C,S}$+58 psig); or about 100 kPa (0 psig) to about $P_{C,S}$+300 kPa ($P_{C,S}$+29 psig).

The one or more asphaltene strippers 311 can include any system or device suitable for selectively separating the mixture in line 309 to provide the overhead in line 313 and the bottoms in line 315. In one or more embodiments, the asphaltene stripper 311 can include, but is not limited to internals such as rings, saddles, balls, irregular sheets, tubes, spirals, trays, baffles, or the like, or any combinations thereof. In one or more embodiments, the asphaltene stripper 311 can be an open column with or without internals. The one or more asphaltene strippers 311 can operate at a temperature of about 30° C. (86° F.) to about 600° C. (1,112° F.); about 100° C. (212° F.) to about 550° C. (1,022° F.); or about 300° C. (572° F.) to about 550° C. (1,022° F.). The one or more asphaltene strippers 311 can operate at a pressure of about 100 kPa (0 psig) to about 4,000 kPa (566 psig); about 500 kPa (58 psig) to about 3,300 kPa (464 psig); or about 1,000 kPa (131 psig) to about 2,500 kPa (348 psig).

The overhead in line 303 can be heated using one or more heat exchangers (two are shown) 331, 333 to provide a heated overhead via line 335. In one or more embodiments, the temperature of the heated overhead in line 335 can be increased above the critical temperature of the solvent $T_{C,S}$. In one or more embodiments, the temperature of the heated overhead in line 335 can be increased using the one or more heat exchangers 331 and/or 333 to a range from about 25° C. (77° F.) to about $T_{C,S}$+150° C. ($T_{C,S}$+302° F.); about $T_{C,S}$−100° C. ($T_{C,S}$−212° F.) to about $T_{C,S}$+100° C. ($T_{C,S}$+212° F.); or about $T_{C,S}$−50° C. ($T_{C,S}$−122° F.) to about $T_{C,S}$+50° C. ($T_{C,S}$+122° F.).

The one or more heat exchangers 331, 333 can include any system or device suitable for increasing the temperature of the overhead in line 303. In one or more embodiments, the heat exchanger 331 can be a regenerative type heat exchanger using a heated process stream, for example an overhead via line 339 from the separator 337, to heat the overhead in line 303 prior to introduction to the separator 337. In one or more embodiments, the one or more heat exchangers 331, 333 can operate at a temperature of about 25° C. (77° F.) to about $T_{C,S}$+150° C. ($T_{C,S}$+302° F.); about $T_{C,S}$−100° C. ($T_{C,S}$−212° F.) to about $T_{C,S}$+100° C. ($T_{C,S}$+212° F.); or about $T_{C,S}$−50° C. ($T_{C,S}$−122° F.) to about $T_{C,S}$+50° C. ($T_{C,S}$+122° F.). In one or more embodiments, the one or more heat exchangers 331, 333 can operate at a pressure of about 100 kPa (0 psig) to about $P_{C,S}$+700 kPa ($P_{C,S}$+87 psig); about 100 kPa (0 psig) to about $P_{C,S}$+500 kPa ($P_{C,S}$+58 psig); or about 100 kPa (0 psig) to about $P_{C,S}$+300 kPa ($P_{C,S}$+29 psig).

The heated overhead in line 335, which can contain the mixture of DAO and the solvent can be introduced into the one or more separators 337 and selectively separated therein to provide the overhead via line 339 and a bottoms via line 341. In one or more embodiments, the overhead in line 339 can contain a first portion of the solvent from the overhead in line 335, and the bottoms in line 341 can contain DAO and a second portion of the solvent. In one or more embodiments, the solvent concentration in the overhead in line 339 can range from about 80% wt to about 100% wt; about 85% wt to about 99% wt; or about 90% wt to about 99% wt. In one or more embodiments, the DAO concentration in the overhead in line 339 can contain from about 0% wt to about 20% wt; about 1% wt to about 15% wt; or about 1% wt to about 10% wt.

In one or more embodiments, the DAO concentration in the bottoms in line 341 can range from about 50% wt to about 100% wt; about 75% wt to about 95% wt; or about 90% wt to about 95% wt. In one or more embodiments, the solvent concentration in the bottoms in line 341 can range from about 0% wt to about 50% wt; about 1% wt to about 40% wt; or about 1% wt to about 10% wt. In one or more embodiments, the specific gravity (at 60° F.) of the bottoms in line 341 can range from about −5° API to about 30° API; about −5° API to about 20° API; or about −5° API to about 15° API.

The one or more separators 337 can include any system or device suitable for separating DAO and the solvent to provide the overhead in line 339 and the bottoms in line 341. In one or more embodiments, the separator 337 can contain internals such as rings, saddles, structured packing, balls, irregular sheets, tubes, spirals, trays, baffles, or any combinations thereof. In one or more embodiments, the separator 337 can be an open column without internals. The separator 337 can operate at a temperature of about 15° C. (59° F.) to about 600° C. (1,112° F.); about 15° C. (59° F.) to about 500° C. (932° F.); or about 15° C. (59° F.) to about 400° C. (752° F.). The pressure in the separator 337 can range from about 100 kPa (0 psig) to about 6,000 kPa (855 psig); about 500 kPa (58 psig) to about 3,300 kPa (464 psig); or about 1,000 kPa (131 psig) to about 2,500 kPa (348 psig).

In one or more embodiments, at least a portion of the bottoms in line 341 can be directed to the one or more strippers 343 and selectively separated therein to provide an overhead via line 345 and a bottoms via line 35. Although not shown, all or a portion of the bottoms in line 341 can be recovered as a DAO product via line 35. In one or more embodiments, the overhead in line 345 can contain a first portion of the solvent, and the bottoms in line 35 can contain DAO and a second portion of the solvent. In one or more embodiments, steam can be added via line 347 to the stripper 343 to enhance the separation of the solvent from the DAO. The steam in line 347 can be at a pressure ranging from about 200 kPa (15 psig) to about 2,160 kPa (298 psig); from about 300 kPa (29 psig) to about 1,475 kPa (199 psig); or from about 400 kPa (44 psig) to about 1,130 kPa (149 psig). The solvent concentration in the overhead in line 345 can range from about 80% wt to about 100% wt; about 85% wt to about 99.9% wt; or about 90% wt to about 99.9% wt. The DAO concentration in the overhead in line 345 can range from about 0% wt to about 20% wt; about 0.1% wt to about 15% wt; or about 0.1% wt to about 10% wt.

In one or more embodiments, at least a portion of the DAO in line 35 can be further processed or upgraded. For example, the DAO in line 35 can be upgraded through hydroprocessing, catalytic cracking, or a combination thereof. The upgraded DAO, e.g. hydroprocessed and catalytically cracked, can provide one or more olefins. The upgraded DAO can include ethylene, propylene, and butane.

The DAO concentration in the bottoms in line 35 can range from about 80% wt to about 100% wt; about 85% wt to about 97% wt; or about 90% wt to about 95% wt. The solvent concentration in the bottoms in line 35 can range from about 1% wt to about 20% wt; about 3% wt to about 15% wt; or about 5% wt to about 10% wt. The specific gravity at 15.6° C. (60° F.) of the bottoms in line 35 can range from a low of about −5° API, about 0° API, or about 5° API to a high of about 22° API, about 25° API, or about 35° API.

The one or more strippers 343 can include any system or device suitable for separating DAO and solvent to provide the overhead via line 345 and the bottoms via line 35. In one or more embodiments, the stripper 343 can contain internals such as rings, saddles, structured packing, balls, irregular sheets, tubes, spirals, trays, baffles, or any combinations thereof. In one or more embodiments, the stripper 343 can be an open column without internals. The one or more strippers 343 can operate at a temperature of about 15° C. (59° F.) to about 600° C. (1,112° F.); about 15° C. (59° F.) to about 500° C. (932° F.); or about 15° C. (59° F.) to about 400° C. (752° F.). The one or more strippers 343 can operate at a pressure of from about 100 kPa (0 psig) to about 4,000 kPa (566 psig); about 500 kPa (58 psig) to about 3,300 kPa (464 psig); or about 1,000 kPa (131 psig) to about 2,500 kPa (348 psig).

In one or more embodiments, all or a portion of the overheads in lines 313 and 345 can be combined to provide a recycled solvent via line 319. The recycled solvent in line 319 can be a single phase or a two phase mixture containing both liquid and vapor. The temperature of the recycled solvent in line 319 can range from about 20° C. (68° F.) to about 600° C. (1,112° F.); about 100° C. (212° F.) to about 550° C. (1,022° F.); or about 300° C. (572° F.) to about 500° C. (932° F.).

The recycled solvent in line 319 can be condensed using one or more condensers 321, thereby providing a cooled solvent in line 323. The cooled solvent in line 323 can have a temperature of about 10° C. (50° F.) to about 400° C. (752° F.); about 25° C. (77° F.) to about 200° C. (392°); or about 30° C. (86° F.) to about 100° C. (212° F.). The solvent concentration in line 323 can range from about 80% wt to about 100% wt; about 85% wt to about 99% wt; or about 90% wt to about 99% wt.

The one or more condensers 321 can include any system or device suitable for decreasing the temperature of the recycled solvents in line 319 to provide the condensed solvent via line 323. In one or more embodiments, the condenser 321 can include, but is not limited to liquid or air cooled shell-and-tube, plate and frame, fin-fan, or spiral wound cooler designs. In one or more embodiments, a cooling medium such as water, refrigerant, air, or combinations thereof can be used to remove the necessary heat from the recycled solvents in line 319. The one or more condensers 321 can operate at a temperature of about −20° C. (−4° F.) to about $T_{C,S}$° C.; about −10° C. (14° F.) to about 300° C. (572° F.); or about 0° C. (32° F.) to about 300° C. (572° F.). The one or more condensers 321 can operate at a pressure of about 100 kPa (0 psig) to about $P_{C,S}$+700 kPa ($P_{C,S}$+87 psig); or about 100 kPa (0 psig) to about $P_{C,S}$+500 kPa ($P_{C,S}$+58 psig); or about 100 kPa (0 psig) to about $P_{C,S}$+300 kPa ($P_{C,S}$+29 psig).

At least a portion of the condensed solvent in line 323 can be stored in one or more accumulators 325. At least a portion of the recycled solvent in the accumulator 325 can be recycled via line 329 using one or more pumps 327. The recycled solvent in line 329 can be combined with at least a portion of the overhead in line 339 to provide the solvent recycle via line 40. In one or more embodiments, at least a portion of the solvent via line 40 can be recycled to the mixer 15.

The temperature of the recycled solvent in line 40 can be adjusted by passing the appropriate heating or cooling media through one or more optional heat exchangers 349. In one or more embodiments, the temperature of the solvent in line 40 can range from about 10° C. (50° F.) to about 400° C. (752° F.); about 25° C. (77° F.) to about 200° C. (392°); or about 30° C. (86° F.) to about 100° C. (212° F.). The solvent concentration in line 40 can range from about 80% wt to about 100% wt; about 90% wt to about 99% wt; or about 95% wt to about 99% wt.

The one or more heat exchangers 349 can include, but are not limited to, liquid or gas, heated or cooled, shell-and-tube, plate and frame, fin-fan, or spiral wound designs. In one or more embodiments, the one or more heat exchangers 349 can operate at a temperature of about −20° C. (−4°) to about $T_{C,S}$° C.; about −10° C. (14° F.) to about 300° C. (572° F.); or about 0° C. (32° F.) to about 300° C. (572° F.). In one or more embodiments, the one or more heat exchangers 349 can operate at a pressure of from about 100 kPa (0 psig) to about $P_{C,S}$+700 kPa ($P_{C,S}$+87 psig); or about 100 kPa (0 psig) to about $P_{C,S}$+500 kPa ($P_{C,S}$+58 psig); or about 100 kPa (0 psig) to about $P_{C,S}$+300 kPa ($P_{C,S}$+29 psig).

Figure 4:
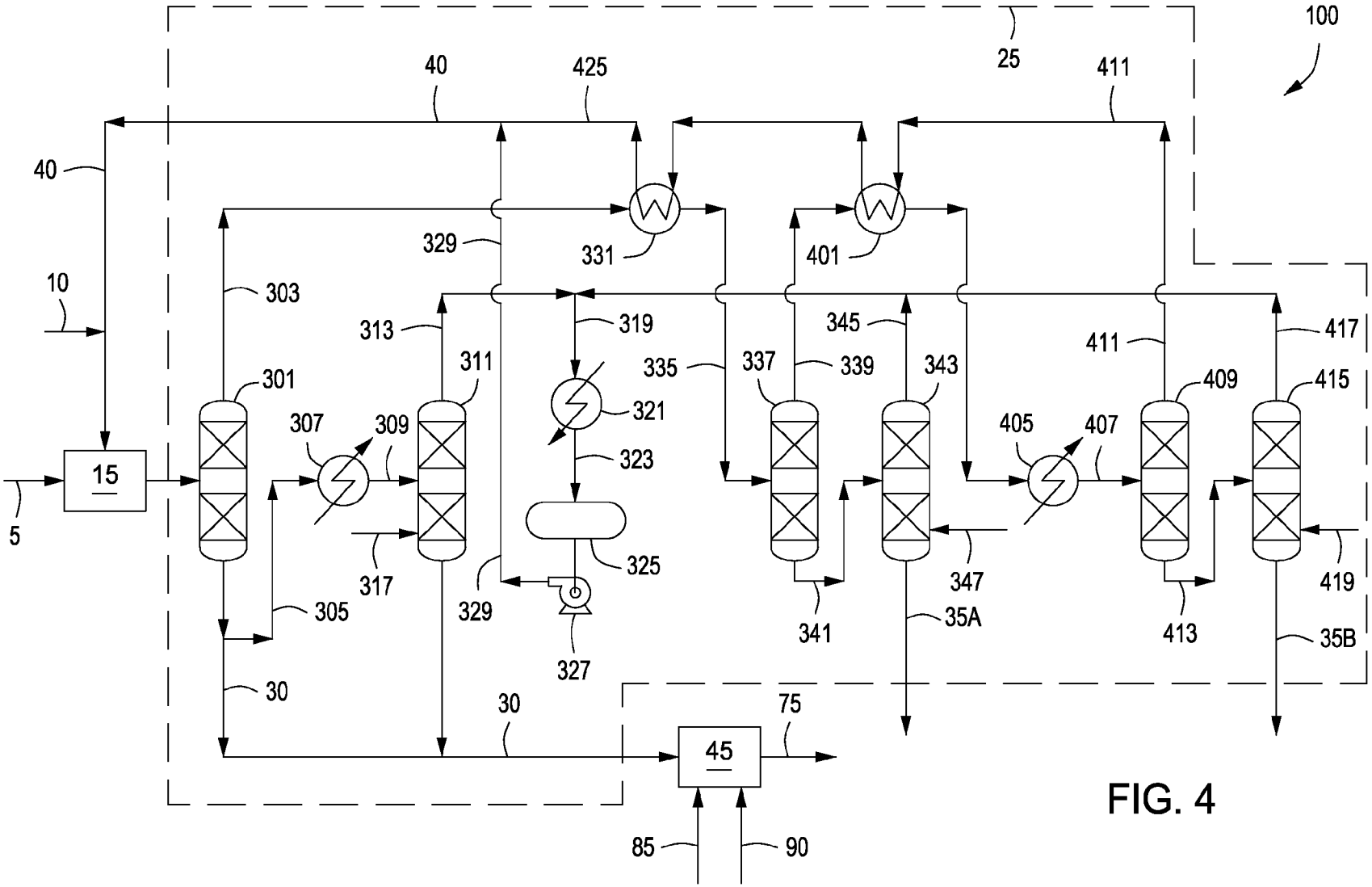
FIG. 4 depicts another illustrative separator/solvent extraction system for use with an integrated deasphalting and gasification system, according to one or more embodiments described.

FIG. 4 depicts another illustrative separator/solvent extraction system 25 for use with an integrated deasphalting and gasification system 100, according to one or more embodiments. In addition to the system shown and described above with reference to FIG. 3, the extraction system 25 can further include one or more separators 409 and one or more strippers 415 for the selective separation of the DAO or overhead in line 303 into a heavy deasphalted oil or resin fraction via line 35A and a light deasphalted oil fraction via line 35B.

The term "light deasphalted oil" ("light-DAO") as used herein refers to a hydrocarbon or mixture of hydrocarbons sharing similar physical properties and containing less than 5%, 4%, 3%, 2% or 1% asphaltenes. In one or more embodiments, the similar physical properties can include a boiling point of about 315° C. (599° F.) to about 610° C. (1,130° F.) and a flash point of about 130° C. (266° F.) or more. In one or more embodiments, the light-DAO can have a viscosity of from about 40 cSt to about 300 cSt, from about 40 cSt to about 200 cSt, or from about 40 cSt to about 100 cSt at 50° C. (122° F.).

The term "heavy deasphalted oil" ("heavy-DAO") as used herein refers to a hydrocarbon or mixture of hydrocarbons sharing similar physical properties and containing less than 5%, 4%, 3%, 2% or 1% asphaltenes. The heavy-DAO can include a boiling point of from about 200° C. (392° F.) to about 800° C. (1,472° F.) and a flash point of about 150° C. (302° F.) or more. In one or more embodiments, the heavy-DAO can have a viscosity of from about 50 cSt to about 500 cSt, from about 50 cSt to about 300 cSt, or from about 50 cSt to about 175 cSt at 50° C. (122° F.).

In one or more embodiments, the overhead in line 303 can be heated in one or more heat exchangers 331 (only one is shown) to supercritical conditions based upon the critical temperature of the particular solvent to provide a heated overhead via line 335. The heated overhead in line 335 can also be heated to a temperature in excess of the critical temperature of the solvent ("$T_{C,S}$") to enhance the separation of the DAO into a light-DAO fraction and a heavy-DAO fraction. The temperature of the heated overhead in line 335 can be increased above the critical temperature of the solvent in line 335 and introduced to the one or more separators 337 to provide a bottoms containing the heavy-DAO fraction and at least a portion of the solvent via line 341, and an overhead containing the light-DAO fraction and the balance of the solvent via line 339. The temperature of the heated overhead in line 335 can range from about 15° C. (59° F.) to about $T_{C,S}$+150° C. ($T_{C,S}$+302° F.); about 15° C. (59° F.) to about $T_{C,S}$+100° C. ($T_{C,S}$+212° F.); or about 15° C. (59° F.) to about $T_{C,S}$+50° C. ($T_{C,S}$+122° F.).

The overhead in line 339 can range from about 1% wt to about 50% wt; about 5% wt to about 40% wt; or about 10% wt to about 30% wt. The solvent concentration in the overhead in line 339 can range from about 50% wt to about 99% wt; about 60% wt to about 95% wt; or about 70% wt to about 90% wt. The overhead in line 339 can contain less than about 50% wt heavy-DAO; less than about 30% wt heavy-DAO; less than about 15% wt heavy-DAO, or less than about 5% wt heavy-DAO.

The heavy-DAO concentration in the bottoms in line 341 can range from about 1% wt to about 50% wt; about 25% wt to about 50% wt; or about 40% wt to about 50% wt. The solvent concentration in the bottoms in line 341 can range from about 0.1% wt to about 50% wt; about 20% wt to about 50% wt; or about 30% wt to about 50% wt.

The one or more separators 337 can include any system or device suitable for separating the heated overhead in line 335 to provide the overhead via line 339 and the bottoms via line 341. The one or more separators 337 can include one or more multi-staged extractors having alternate segmental baffle trays, packing, perforated trays or the like, or combinations thereof The separator 337 can be an open column with or without internals. The temperature in the one or more separators 337 can range from about 15° C. (59° F.) to about $T_{C,S}$+150° C. ($T_{C,S}$+302° F.); about 15° C. (59° F.) to about $T_{C,S}$+100° C. ($T_{C,S}$+212° F.); or about 15° C. (59° F.) to about $T_{C,S}$+50° C. ($T_{C,S}$+122° F.). The the one or more separators 337 can operate at a pressure of from about 100 kPa (0 psig) to about $P_{C,S}$+700 kPa ($P_{C,S}$+87 psig); about $P_{C,S}$−700 kPa ($P_{C,S}$−87 psig) to about $P_{C,S}$+700 kPa ($P_{C,S}$+87 psig); or about $P_{C,S}$−300 kPa ($P_{C,S}$−29 psig) to about $P_{C,S}$+300 kPa ($P_{C,S}$+29 psig).

The bottoms in line 341 can be introduced into the one or more strippers 343 and selectively separated therein to provide an overhead, which can contain the solvent via line 345 and a bottoms, which can contain the heavy-DAO, via line 35A. In one or more embodiments, steam via line 347 can be added to the stripper 343 to enhance the separation of the solvent from the heavy-DAO. The overhead in line 345 can contain a first portion of the solvent, and the bottoms in line 35A can contain heavy-DAO and the balance of the solvent. In one or more embodiments, at least a portion of the bottoms in line 35A can be directed for further processing (not shown), which can include, but is not limited to, upgrading through hydrotreating, catalytic cracking, or a combination thereof. The solvent concentration in the overhead in line 345 can range from about 85% wt to about 100% wt; about 90% wt to about 99% wt; or about 95% wt to about 99% wt. The heavy-DAO concentration in the overhead in line 345 can range from about 0% wt to about 15% wt; about 1% wt to about 10% wt; or about 1% wt to about 5% wt.

In one or more embodiments, the heavy-DAO concentration in the bottoms in line 35A can range from about 80% wt to about 95% wt; about 85% wt to about 97% wt; or about 90% wt to about 97% wt. The solvent concentration in the bottoms in line 35A can range from about 1% wt to about 20% wt; about 1% wt to about 15% wt; or about 1% wt to about 10% wt. The specific gravity (API@60° F.) of the bottoms in line 35A can range from about 5° API to about 35° API; about 10° API to about 30° API; or about 10° API to about 25° API.

The one or more strippers 343 can include any system or device suitable for separating the heavy-DAO and solvents present in the bottoms in line 341 to provide the overhead via line 345 and the bottoms via line 35A. In one or more embodiments, the one or more strippers 343 can contain internals such as rings, saddles, structured packing, balls, irregular sheets, tubes, spirals, trays, baffles, or any combinations thereof. In one or more embodiments, the one or more strippers 343 can be an open column without internals. The operating temperature of the one or more strippers 343 can range from about 15° C. (59° F.) to about 600° C. (1,112° F.); about 15° C. (59° F.) to about 500° C. (932° F.); or about 15° C. (59° F.) to about 400° C. (752° F.). The one or more strippers 343 can operate at a pressure of from about 100 kPa (0 psig) to about 4,000 kPa (566 psig); about 500 kPa (58 psig) to about 3,300 kPa (464 psig); or about 1,000 kPa (131 psig) to about 2,500 kPa (348 psig).

In one or more embodiments, the overhead in line 339 can be heated using one or more heat exchangers (two are shown 401, 405) to provide a heated overhead in line 407. The temperature of the heated overhead in line 407 can range from about 15° C. (59° F.) to about $T_{C,S}$+150° C. ($T_{C,S}$+302° F.); about 15° C. (59° F.) to about $T_{C,S}$+100° C. ($T_{C,S}$+212° F.); or about 15° C. (59° F.) to about $T_{C,S}$+50° C. ($T_{C,S}$+122° F.).

In one or more embodiments, the temperature from the heat exchangers 401, 405 can range from about 15° C. (59° F.) to about $T_{C,S}$+150° C. ($T_{C,S}$+302° F.); about 15° C. (59° F.) to about $T_{C,S}$+100° C. ($T_{C,S}$+212° F.); or about 15° C. (59° F.) to about $T_{C,S}$+50° C. ($T_{C,S}$+122° F.). The heat exchangers 401, 405 can operate at a pressure of about 100 kPa (0 psig) to about $P_{C,S}$+700 kPa ($P_{C,S}$+87 psig); about 100 kPa (0 psig) to about $P_{C,S}$+500 kPa ($P_{C,S}$+58 psig); or about 100 kPa (0 psig) to about $P_{C,S}$+300 kPa ($P_{C,S}$+29 psig).

In one or more embodiments, the heated overhead in line 407 can be introduced to the one or more separators 409 and selectively separated therein to provide an overhead via line 411 and a bottoms via line 413. The overhead in line 411 can contain, but is not limited to, the In one or more embodiments, the light-DAO concentration in line 413 can range from about 80% wt to about 100% wt; about 85% wt to about 95% wt; or about 90% wt to about 95% wt. The solvent concentration in line 413 can range from about 10% wt to about 90% wt; about 20% wt to about 75% wt; or about 30% wt to about 60% wt.

The one or more separators 409 can include any system or device suitable for separating the heated overhead in line 407 to provide the overhead containing solvent via line 411 and the bottoms containing light-DAO via line 413. In one or more embodiments, the one or more separators 409 can include one or more multi-staged extractors having alternate segmental baffle trays, packing, structured packing, perforated trays, and combinations thereof. In one or more embodiments, the one or more separators 409 can be an open column without internals. The one or more separators 409 can operate at a temperature of about 15° C. (59° F.) to about $T_{C,S}$+150° C. ($T_{C,S}$+302° F.); about 15° C. (59° F.) to about $T_{C,S}$+150° C. ($T_{C,S}$+302° F.); or about 15° C. (59° F.) to about $T_{C,S}$+50° C. ($T_{C,S}$+122° F.). The one or more separators 409 can operate at a pressure of about 100 kPa (0 psig) to about $P_{C,S}$+700 kPa ($P_{C,S}$+87 psig); about $P_{C,S}$−700 kPa ($P_{C,S}$−87 psig) to about $P_{C,S}$+700 kPa ($P_{C,S}$+87 psig); or about $P_{C,S}$−300 kPa ($P_{C,S}$−29 psig) to about $P_{C,S}$+300 kPa ($P_{C,S}$+29 psig).

In one or more embodiments, the bottoms in line 413 can be introduced into the one or more strippers 415 and selectively separated therein to provide an overhead via line 417 and a bottoms via line 35B. The overhead in line 417 can contain, but is not limited to, at the solvent and the bottoms in line 35B can contain, but is not limited to, light-DAO. In one or more embodiments, steam via line 419 can be added to the stripper to enhance the separation of the solvent from the light-DAO. In one or more embodiments, at least a portion of the light-DAO in line 35B can be directed for further processing (not shown), which can include, but is not limited to, hydrocracking. The solvent concentration in the overhead in line 417 can range from about 80% wt to about 100% wt; about 85% wt to about 99% wt; or about 90% wt to about 99% wt. The light-DAO concentration in line 417 can range from about 0% wt to about 20% wt; about 1% wt to about 15% wt; or about 1% wt to about 10% wt.

In one or more embodiments, the light-DAO concentration in the bottoms in line 35B can range from about 80% wt to about 99% wt; about 85% wt to about 95% wt; or about 90% wt to about 99% wt. The solvent concentration in line 35B can range from about 1% wt to about 20% wt; about 1% wt to about 15% wt; or about 1% wt to about 10% wt. In one or more embodiments, the specific gravity (API 15.6° C. (60° F.)) of the bottoms in line 35B can range from about 20° API to about 50° API; about 20° API to about 45° API; or about 25° API to about 45° API.

In one or more embodiments, the one or more strippers 415 can contain internals such as rings, saddles, structured packing, balls, irregular sheets, tubes, spirals, trays, baffles, or any combinations thereof. In one or more embodiments, the stripper 415 can be an open column without internals. The one or more strippers 415 can operate at a temperature of about 15° C. (59° F.) to about $T_{C,S}$+150° C. ($T_{C,S}$+302° F.); about 15° C. (59° F.) to about $T_{C,S}$+150° C. ($T_{C,S}$+302° F.); or about 15° C. (59° F.) to about $T_{C,S}$+50° C. ($T_{C,S}$+122° F.). The one or more strippers 415 can operate at a pressure of about 100 kPa (0 psig) to about $P_{C,S}$+700 kPa ($P_{C,S}$+87 psig); about $P_{C,S}$−700 kPa ($P_{C,S}$−87 psig) to about $P_{C,S}$+700 kPa ($P_{C,S}$+87 psig); or about $P_{C,S}$−300 kPa ($P_{C,S}$−29 psig) to about $P_{C,S}$+300 kPa ($P_{C,S}$+29 psig).

In one or more embodiments, at least a portion of the solvent in the overhead in lines 319, 345, and 417 can be combined to provide a recycle solvent in line 319. In one or more embodiments, the recycle solvent in line 319 can be present as a two phase liquid/vapor mixture. In one or more embodiments, the recycle solvent in line 319 can be partially or completely condensed using one or more condensers 321 to provide a condensed solvent via line 323. The condensed solvent in line 323 can be stored or accumulated using one or more accumulators 325.

The one or more condensers 321 can include any system or device suitable for decreasing the temperature of the combined solvent overhead in line 319. In one or more embodiments, the one or more condensers 319 can include, but is not limited to liquid or air cooled shell-and-tube, plate and frame, fin-fan, or spiral wound cooler designs. In one or more embodiments, a cooling medium such as water, refrigerant, air, or combinations thereof can be used to remove the necessary heat from the combined solvent overhead in line 319. The one or more condensers 321 can operate at a temperature of about −20° C. (−4° F.) to about $T_{C,S}$° C.; about −10° C. (14° F.) to about 300° C. (572° F.); or about 0° C. (32° F.) to about 300° C. (572° F.). The one or more condensers 321 can operate at a pressure of about 100 kPa (0 psig) to about $P_{C,S}$+700 kPa ($P_{C,S}$+87 psig); about 100 kPa (0 psig) to about $P_{C,S}$+500 kPa ($P_{C,S}$+58 psig); or about 100 kPa (0 psig) to about $P_{C,S}$+300 kPa ($P_{C,S}$+29 psig).

In one or more embodiments, at least a portion of the overhead in line 411 can be cooled using one or more heat exchangers (two are shown 401, 331) to provide a cooled overhead in line 425. In one or more embodiments, at least a portion of the cooled overhead in line 425 can be combined with at least a portion of the recycle solvent in line 329 and recycled to the one or more mixers 15 via line 40. Recycling at least a portion of the solvent to the solvent deasphalting process can decrease the quantity of make-up solvent via line 10 required. In one or more embodiments, prior to introduction to the one or more heat exchangers 401, 331, the overhead in line 411 can be at a temperature of about 25° C. (77° F.) to about $T_{C,S}$; about 150° C. (302° F.) to about $T_{C,S}$; or about 200° C. (392° F.) to about $T_{C,S}$. In one or more embodiments, after exiting the one or more heat exchangers 401, 331, the temperature of the cooled overhead in line 425 can range from about 25° C. (77°) to about 400° C. (752° F.); about 50° C. (122° F.) to about 300° C. (572° F.); or about 100° C. (212° F.) to about 250° C. (482° F.).

Figure 5:
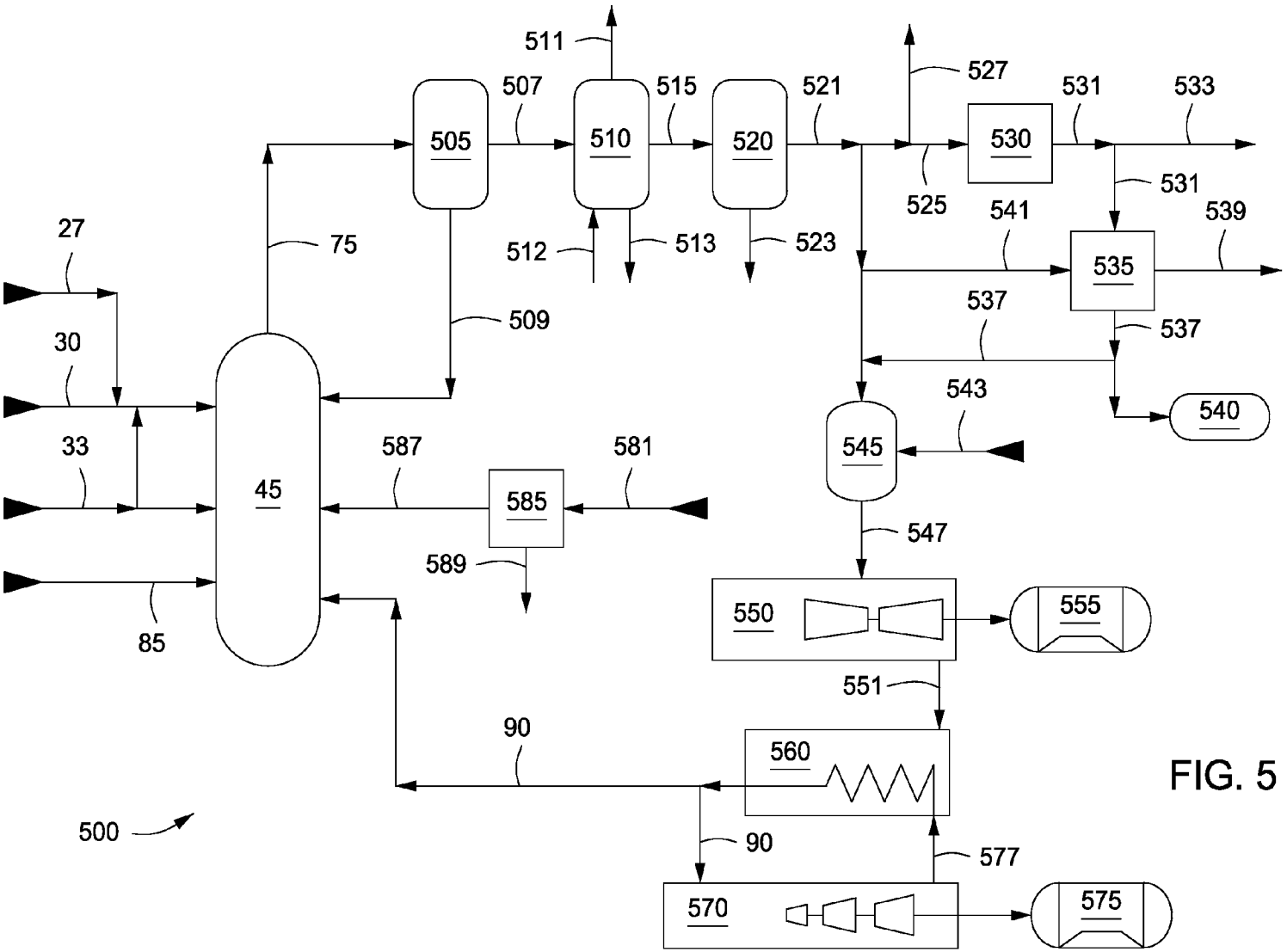
FIG. 5 depicts an illustrative gasification system for use with an integrated deasphalting and gasification system, according to one or more embodiments described.

FIG. 5 depicts an illustrative gasification system 500 for use with an integrated deasphalting and gasification system, according to one or more embodiments. In one or more embodiments, the gasification system 500 can include one or more gasifiers 45, one or more particulate removal systems 505, one or more product separation and cooling systems 510, and one or more syngas purification systems 520. In one or more embodiments, the gasification system 500 can include one or more gas converters 530 to convert at least a portion of the syngas to one or more Fischer-Tropsch products, methanol, ammonia, chemicals, derivatives thereof, and combinations thereof. In one or more embodiments, the gasification system 500 can include one or more hydrogen separators 535, one or more fuel cells 540, one or more combustors 545, one or more gas turbines 550, one or more waste heat boilers 560, one or more steam turbines 570, one or more generators 555, 575, and one or more air separation units ("ASU") 585 to produce hydrogen fuel, power, steam, and/or energy.

In one or more embodiments, at least a portion of the asphaltene-rich mixture via line 30 and the optional carbonaceous material via line 27 can be introduced to the one or more gasifiers 45 as discussed and described above in reference to FIGS. 1 and 2. In one or more embodiments, one or more sorbents (oxygen scavengers), steam, and/or the one or more carrier fluids can be introduced via line 33 to the asphaltene-rich mixture in line 30 or directly to the gasifier 45 as discussed and described above in reference to FIG. 1. In one or more embodiments, the oxidant via line 85 and steam via line 90 can be introduced to the gasifier 45 as discussed and described above in reference to FIGS. 1 and 2. The asphaltene-rich mixture and/or carbonaceous material can be vaporized, cracked, combusted, and/or gasified in gasifier 45 as discussed and described above in reference to FIGS. 1 and 2 to provide the one or more products via line 75.

The quantity and type of oxidant added to the gasifier can determine the composition and physical properties of the syngas and hence, the downstream products made therefrom. The oxidant can include, but is not limited to: air, oxygen, essentially oxygen, oxygen-enriched air, mixtures of oxygen and air, mixtures of oxygen and inert gas such as nitrogen and argon, and combinations thereof. The oxidant can contain about 65% vol oxygen or more, or about 70% vol oxygen or more, or about 75% vol oxygen or more, or about 80% vol oxygen or more, or about 85% vol oxygen or more, or about 90% vol oxygen or more, or about 95% vol oxygen or more, or about 99% vol oxygen or more. As used herein, the term "essentially oxygen" refers to a gas containing 51% vol oxygen or more. As used herein, the term "oxygen-enriched air" refers to a gas containing 21% vol oxygen or more. Oxygen-enriched air can be obtained, for example, from cryogenic distillation of air, pressure swing adsorption, membrane separation or any combination thereof.

In one or more embodiments, in addition to or in lieu of the oxidant via line 85, the ASU 585 can introduce, via line 587, an essentially nitrogen-free oxidant to the gasifier 45. The ASU 585 can be a high-pressure, cryogenic type separator. Air can be introduced to the ASU 585 via line 581 and separated nitrogen can be recovered via line 589 and the essentially nitrogen-free air can be obtained via line 587. The use of an essentially nitrogen-free oxidant allows the gasifier 45 to produce the one or more products ("products") via line 75 that can be essentially nitrogen-free, e.g. containing less than 0.5% nitrogen/argon. The separated nitrogen via line 589 from the ASU 585 can be vented to the atmosphere, added to a combustion turbine (not shown), or used as utility (not shown). The ASU 585 can provide from about 10%, about 30%, about 50%, about 70%, about 90%, or about 100% of the total oxidant fed to the gasifier 45.

As described and discussed above in reference to FIG. 1, the one or more products provided by the gasifier 45 and recovered via line 75 can contain hydrocarbon gases and syngas. The one or more products can be introduced via line 75 to one or more particulate removal systems 505 which can be used to partially or completely remove solids from the one or more products to provide separated solids via line 509 and solids-lean products via line 507. In one or more embodiments, the separated solids in line 509 can be recycled to the gasifier 45 or optionally purged from the system (not shown). The one or more particulate removal systems 505 can include one or more separation devices such as conventional disengagers and/or cyclones (not shown). Particulate control devices ("PCD") capable of providing an outlet particulate concentration below the detectable limit of about 0.1 ppmw can also be used. Illustrative PCDs can include, but are not limited to, electrostatic precipitators, sintered metal filters, metal filter candles, and/or ceramic filter candles (for example, iron aluminide filter material). Although not shown, in one or more embodiments, the one or more products via line 75 can be introduced to one or more product separation and cooling systems 510 prior to the particulate removal system 505.

In one or more embodiments, the solids-lean products via line 507 can be introduced to the one or more product separation and cooling systems 510 to provide hydrocarbon products via line 511 and syngas via line 515. The product separation and cooling system 510 can include one or more distillation columns, membrane separation units, or any other suitable device or system that can provide one or more separated hydrocarbon products via line 511 and syngas via line 515.

In one or more embodiments, the product separation and cooling system 510 can include one or more coolers. In one or more embodiments, the cooler can cool the solids-lean products introduced via line 507 using non-contact heat exchange with a cooling medium, for example boiler feed water introduced via line 512 and recovered via line 513. In one or more embodiments, the cooler can cool the solids-lean hydrocarbon products using contact cooling wherein the solids-lean hydrocarbon products can be mixed directly with the cooling medium, such as water or other suitable quench fluid. In one or more embodiments, the solids-lean hydrocarbon products in line 507 can be cooled to about 500° C. (932° F.) or less, 400° C. (752° F.) or less, 300° C. (572° F.) or less, 200° C. (392° F.) or less, or 150° C. (302° F.) or less using the one or more coolers. Although not shown, in one or more embodiments, the heated cooling medium can be sent to the heat recovery steam generation unit 560 and/or to the one or more steam turbines 570.

In one or more embodiments, the product separation and the product cooling can occur in either order. In one or more embodiments, the products, such as methane, ethane, propane, and butane, can first be cooled and then separated to provide the hydrocarbon products via line 511 and the syngas via line 515. The sequence of product separation and cooling can be determined by process conditions, available equipment, and economic factors. In one or more embodiments, at least a portion of the hydrocarbon products via line 511 can be recycled (not shown) to the one or more mixing units to provide at least a portion of the solvent. In one or more embodiments, at least a portion of the hydrocarbon products via line 511 can be further processed ("upgraded") into more valuable products or sold (not shown).

The syngas in line 515 can contain 80% vol, about 85% vol or more, about 90% vol or more, or about 95% vol or more hydrogen, carbon monoxide, and carbon dioxide. The syngas in line 515 can contain 75% vol or more carbon monoxide and hydrogen with the balance being primarily carbon dioxide and methane. The carbon monoxide content of the syngas in line 515 can range from a low of about 10% vol, about 20% vol, or about 30% vol to a high of about 50% vol, about 70% vol or about 85% vol. The hydrogen content of the syngas can range from a low of about 1% vol, about 5% vol, or about 10% vol to a high of about 30% vol, about 40% vol or 5 about 0% vol. The hydrogen content of the syngas can range from about 20% vol to about 30% vol. The syngas in line 515 can contain less than about 25% vol, less than about 20% vol, less than about 15% vol, less than about 10% vol, or less than about 5% vol of combined nitrogen, methane, carbon dioxide, water, hydrogen sulfide, and hydrogen chloride. The syngas in line 515 can contain less than about 25% vol, less than about 20% vol, less than about 15% vol, less than about 10% vol, or less than about 5% vol of combined methane, carbon dioxide, water, hydrogen sulfide, and hydrogen chloride.

The carbon dioxide concentration in the syngas can be about 25% vol or less, 20% vol or less, 15% vol or less, 10% vol or less, 5% vol or less, 3% vol or less, 2% vol or less, or 1% vol or less. The methane concentration in the syngas in line 515 can be about 15% vol or less, 10% vol or less, 5% vol or less, 3% vol or less, 2% vol or less, or 1% vol or less. The water concentration in the syngas in line 515 can be about 40% vol or less, 30% vol or less, 20% vol or less, 10% vol or less, 5% vol or less, 3% vol or less, 2% vol or less, or 1% vol or less. The syngas in line 515 can be nitrogen-free or essentially nitrogen-free, e.g. containing less than 0.5% vol nitrogen.

The heating value of the syngas in line 515, corrected for heat losses and dilution effects, can range from about 1,850 kJ/m$^3$ (50 Btu/scf) to about 2,800 kJ/m$^3$ (75 Btu/scf), about 1,850 kJ/m$^3$ (50 Btu/scf) to about 3,730 kJ/m$^3$ (100 Btu/scf), about 1,850 kJ/m$^3$ (50 Btu/scf) to about 4,100 kJ/m$^3$ (110 Btu/scf), about 1,850 kJ/m$^3$ (50 Btu/scf) to about 5,200 kJ/m$^3$ (140 Btu/scf), about 1,850 kJ/m$^3$ (50 Btu/scf) to about 6,700 kJ/m$^3$ (180 Btu/scf), about 1,850 kJ/m$^3$ (50 Btu/scf) to about 7,450 kJ/m$^3$ (200 Btu/scf), about 1,850 kJ/m$^3$ (50 Btu/scf) to about 9,300 kJ/m$^3$ (250 Btu/scf), or about 1,850 kJ/m$^3$ (50 Btu/scf) to about 10,250 kJ/m$^3$ (275 Btu/scf).

In one or more embodiments, the temperature of the syngas in line 515 can be further reduced using one or more secondary coolers (not shown) to provide a cooler syngas. The temperature of the cooler syngas can range from about 50° C. (302° F.) to about 300° C. (572° F.) or from about 150° C. (302° F.) to about 350° C. (662° F.). Although not shown, at least a portion of the syngas in line 515 can be recycled for use as a carrier fluid for the asphaltene-rich mixture in line 30.

In one or more embodiments, at least a portion of the syngas in line 515 can be introduced to one or more syngas purification systems 520. The one or more syngas purification systems 520 can remove contaminants to provide a waste gas via line 523 and a treated syngas via line 521. The one or more syngas purification systems 520 can include one or more systems, processes, or devices to remove contaminants including, but not limited to, sulfur and/or sulfur containing compounds, mercury and/or mercury containing compounds, and carbonyl sulfide from the syngas in line 515. In one or more embodiments, the syngas purification system 520 can be a catalytic purification system, including, but not limited to, one or more systems which can include zinc titanate, zinc ferrite, tin oxide, zinc oxide, iron oxide, copper oxide, cerium oxide, derivatives thereof, mixtures thereof, or combinations thereof. In one or more embodiments, the one or more syngas purification systems 520 can be a process-based purification system, including, but not limited to, one or more systems using the Selexol™ process, the Rectisol® process, the CrystaSulf® process, and the Sulfinol® Gas Treatment Process, or any combination thereof. In one or more embodiments, the one or more syngas purification systems 520 can be a combination of one or more catalytic and one or more process-based purification systems.

In one or more embodiments, one or more amine solvents such as methyl-diethanolamine (MDEA) can be used within the one or more syngas purification systems 520 to remove acid gases from the cooled, separated, syngas via line 515. Physical solvents such as Selexol™ (dimethyl ethers of polyethylene glycol) or Rectisol® (cold methanol), can also be used within the syngas purification system 520. If the syngas via line 515 contains carbonyl sulfide (COS), the carbonyl sulfide can be converted by hydrolysis to hydrogen sulfide by reaction with water over a catalyst and then absorbed using one or more of the methods described above. If the syngas in line 515 contains one or more heavy metals, for example mercury and/or cadmium, a bed of sulfur-impregnated activated carbon, active metal sorbents, such as iridium, palladium, ruthenium, platinum, alloys thereof, combinations thereof, or any other known heavy metal removal technology can be used to remove the one or more heavy metals.

In one or more embodiments, a cobalt-molybdenum ("Co—Mo") catalyst can be incorporated into the one or more syngas purification systems 520 to perform a sour shift conversion of the syngas in line 515. (i.e. the conversion of carbon monoxide to carbon dioxide in the presence of hydrogen sulfide) The Co—Mo catalyst can operate at a temperature of about 290° C. (554° F.) in the presence of hydrogen sulfide ($H_2S$), such as about 100 ppmw $H_2S$. If a Co—Mo catalyst is used to perform a sour shift within the syngas purification system 520, subsequent downstream removal of sulfur and/or sulfur-containing compounds from the shifted syngas can be accomplished using any of the above described sulfur removal methods and/or techniques.

In one or more embodiments, the syngas purification system 520 can include one or more gas converters, for example one or more shift reactors, which can convert at least a portion of the carbon monoxide present in the treated syngas in line 515 to carbon dioxide via a water-gas shift reaction, to adjust the hydrogen ($H_2$) to carbon monoxide (CO) ratio ($H_2$:CO) of the syngas to provide a syngas in line 521 containing shifted syngas. In one or more embodiments, the carbon dioxide can be removed via line 523 to provide a syngas lean in carbon dioxide, e.g. less than about 2% vol carbon dioxide.

In one or more embodiments, at least a portion of the treated syngas in line 521 can be removed via line 527 and sold as a commodity. In one or more embodiments, at least a portion of the treated syngas in line 521 can be introduced via line 525 to the one or more gas converters 530 to provide one or more products via line 531, which can include, but are not limited to, Fischer-Tropsch products, methanol, ammonia, asphaltene-rich mixtures, derivatives thereof, or combinations thereof. In one or more embodiments, at least a portion of the one or more products or converted syngas in line 531 can be sold or upgraded using further downstream processes (not shown), which can be introduced via line 533

In one or more embodiments, at least a portion of the treated syngas in line 521 can be introduced to one or more hydrogen separators 535 via line 541 to provide a hydrogen-rich gas via line 537. In one or more embodiments, at least a portion of the treated syngas via line 521 can be combusted in one or more combustors 545 to provide an exhaust gas. The exhaust gas via line 547 can be introduced to the one or more turbines 550 to produce or generate mechanical power, electrical power and/or steam. In one or more embodiments, at least a portion of the hydrogen-rich gas via line 537 can be introduced to the one or more combustors via line 521 in addition to or in place of the treated syngas.

The one or more gas converters 530 can include one or more shift reactors, which can convert at least a portion of the carbon monoxide present in the treated syngas in line 525 to carbon dioxide via a water-gas shift reaction, to adjust the hydrogen ($H_2$) to carbon monoxide (CO) ratio ($H_2$:CO) of the syngas to provide a product in line 531 containing shifted syngas.

In one or more embodiments, the one or more shift reactors within the gas converter 530 can include, but are not limited to, single stage adiabatic fixed bed reactors; multiple-stage adiabatic fixed bed reactors with or without interstage cooling; steam generation or cold quench reactors; tubular fixed bed reactors with steam generation or cooling; fluidized bed reactors; or any combination thereof. In one or more embodiments, a sorption enhanced water-gas shift (SEWGS) process, utilizing a pressure swing adsorption unit having multiple fixed bed reactors packed with shift catalyst and operated at a high temperature of approximately 475° C. (887° F.) can be used.

In at least one specific embodiment, the one or more gas converters 530 can include two shift reactors arranged in series. A first reactor can be operated at high temperature of from about 300° C. (572° F.) to about 450° C. (842° F.) to convert a majority of the carbon monoxide present in the treated syngas introduced via line 525 to carbon dioxide at a relatively high reaction rate using an iron-chrome catalyst. A second reactor can be operated at a relatively low temperature of from about 150° C. (302° F.) to about 225° C. (437° F.) to further convert remaining carbon monoxide to carbon dioxide using a mixture of copper oxide and zinc oxide. In one or more embodiments, a medium temperature shift reactor can be used in addition to, in place of, or in combination with, the high temperature shift reactor and/or low temperature shift reactor. The medium temperature shift reactor can be operated at a temperature of from about 250° C. (482° F.) to about 300° C. (572° F.).

In one or more embodiments, the carbon dioxide provided from the one or more gas converters 520 can be separated, adsorbed, or otherwise removed from the product in line 531. Suitable carbon dioxide adsorbents and absorption techniques include, but are not limited to, propylene carbonate physical adsorbent; alkyl carbonates; dimethyl ethers of polyethylene glycol of two to twelve glycol units (Selexol™ process); n-methyl-pyrrolidone; sulfolane; and/or use of the Sulfinol® Gas Treatment Process. In one or more embodiments, carbon dioxide recovered from the treated syngas in line 525 can be used to enhance the wellhead production and recovery of crude oil and gas. In an illustrative hydrocarbon production process, carbon dioxide recovered from the treated syngas in line 525 can be injected into, and flushed through, an area beneath an existing hydrocarbon production well where one or more "stranded" hydrocarbon deposits exist.

In one or more embodiments, one of the one or more gas converters 530 can be used to produce one or more Fischer-Tropsch ("F-T") products, including refinery/petrochemical asphaltene-rich mixtures, transportation fuels, synthetic crude oil, liquid fuels, lubricants, alpha olefins, waxes, and the like. The F-T reaction can be carried out in any type reactor, for example, through the use of fixed beds; moving beds; fluidized beds; slurries; bubbling beds, or any combination thereof. The F-T reaction can employ one or more catalysts including, but not limited to, copper-based; ruthenium-based; iron-based; cobalt-based; mixtures thereof, or any combination thereof. The F-T reaction can be carried out at temperatures ranging from about 190° C. (374° F.) to about 450° C. (842° F.) depending on the reactor configuration. Additional reaction and catalyst details can be found in U.S. Publication No. 2005/0284797 and U.S. Pat. Nos. 5,621,155; 6,682,711; 6,331,575; 6,313,062; 6,284,807; 6,136,868; 4,568,663; 4,663,305; 5,348,982; 6,319,960; 6,124,367; 6,087,405; 5,945,459; 4,992,406; 6,117,814; 5,545,674; and 6,300,268.

Fischer-Tropsch products including liquids which can be further reacted and/or upgraded to a variety of finished hydrocarbon products can be produced within the gas converter 530. Certain products, e.g. $C_4$-$C_5$ hydrocarbons, can include high quality paraffin solvents which, if desired, can be hydrotreated to remove olefinic impurities, or employed without hydrotreating to produce a wide variety of wax products. Liquid hydrocarbon products, containing $C_{16}$ and higher hydrocarbons can be upgraded by various hydroconversion reactions, for example, hydrocracking, hydroisomerization, catalytic dewaxing, isodewaxing, or combinations thereof The converted $C_{16}$ and higher hydrocarbons can be used in the production of mid-distillates, diesel fuel, jet fuel, isoparaffinic solvents, lubricants, drilling oils suitable for use in drilling muds, technical and medicinal grade white oil, chemical raw materials, and various hydrocarbon specialty products.

In at least one specific embodiment, at least one of the one or more gas converters 530 can include one or more Fischer-Tropsch slurry bubble column reactors. In one or more embodiments, the catalyst within the slurry bubble column reactors can include, but is not limited to, a titania support impregnated with a salt of a catalytic copper or an Iron Group metal, a polyol or polyhydric alcohol and, optionally, a rhenium compound or salt. Examples of polyols or polyhydric alcohols include glycol, glycerol, derythritol, threitol, ribitol arabinitol, xylitol, allitol, dulcitol, gluciotol, sorbitol, and mannitol. In one or more embodiments, the slurry bubble column reactors can operate at a temperature of less than 220° C. (428° F.) and from about 100 kPa (0 psig) to about 4,150 kPa (588 psig), or about 1,700 kPa (232 psig) to about 2,400 kPa (334 psig) using a cobalt (Co) catalyst promoted with rhenium (Re) and supported on titania having a Re:Co weight ratio in the range of about 0.01 to about 1 and containing from about 2% wt to about 50% wt cobalt.

In one or more embodiments, the one or more Fischer-Tropsch slurry bubble column reactors within the gas converter 530 can use a catalytic metal, such as, copper or an iron group metal within a concentrated aqueous salt solution, for example cobalt nitrate or cobalt acetate. The resultant aqueous salt solution can be combined with one or more polyols, or optionally perrhenic acid, while adjusting the amount of water to obtain approximately 15 wt % cobalt in the solution. Incipient wetness techniques can be used to impregnate the catalyst onto a rutile or anatase titania support, optionally spray-dried, and calcined. This method reduces the need for rhenium promoter within the F-T reactor. Additional details can be found in U.S. Pat. Nos. 5,075,269 and 6,331,575.

In one or more embodiments, the one or more gas converters 530 can produce ammonia, using the Haber-Bosch process. In one or more embodiments, the one or more gas converters 530 can be used for the production of alkyl-formates, for example, the production of methyl formate. Any of several alkyl-formate production processes can be used within the gas converter 530, for example a gas or liquid phase reaction between carbon monoxide and methanol occurring in the presence of an alkaline, or alkaline earth metal methoxide catalyst. Additional details can be found in U.S. Pat. Nos. 3,716,619; 3,816,513; and 4,216,339.

In one or more embodiments, at least one of the one or more gas converters 530 can be used to produce methanol, dimethyl ether, ammonia, acetic anhydride, acetic acid, methyl acetate, acetate esters, vinyl acetate and polymers, ketenes, formaldehyde, dimethyl ether, olefins, derivatives thereof, or combinations thereof. For methanol production, for example, the Liquid Phase Methanol Process can be used (LPMEOH™). In this process, at least a portion of the carbon monoxide in the syngas introduced via line 525 can be directly converted into methanol using a slurry bubble column reactor and catalyst in an inert hydrocarbon oil reaction medium. The inert hydrocarbon oil reaction medium can conserve heat of reaction while idling during off-peak periods for a substantial amount of time while maintaining good catalyst activity. Additional details can be found in U.S. 2006/0149423 and prior published Heydorn, E. C., Street, B. T., and Kornosky, R. M., "Liquid Phase Methanol (LPMEOH™) Project Operational Experience," (Presented at the Gasification Technology Council Meeting in San Francisco on Oct. 4-7, 1998). Gas phase processes for producing methanol can also be used. For example, known processes using copper based catalysts, the Imperial Chemical Industries process, the Lurgi process and the Mitsubishi process can be used.

In one or more embodiments, at least a portion of the carbon monoxide in the treated syngas in line 525 can be separated in the gas converter 530 and recovered as a carbon monoxide-rich gas (not shown). Recovered carbon monoxide can be used in the production of one or more commodity and/or specialty chemicals, including, but not limited to, acetic acid, phosgene, isocyanates, formic acid, propionic acid, mixtures thereof, derivatives thereof, and/or combinations thereof. Although not shown, the carbon monoxide-rich gas from the gas converter 530 can be used to provide at least a portion of the carrier fluid in line 33.

In one or more embodiments, at least a portion of the treated syngas via line 521 can be introduced to one or more hydrogen separators 535 via line 541 to provide a hydrogen-rich gas via line 537. In one or more embodiments, at least a portion of the converted syngas via line 531 can also be directed to the one or more hydrogen separators 535 to provide the hydrogen-rich gas via line 537. In one or more embodiments, the one or more hydrogen separators 535 can include any system or device to selectively separate hydrogen from mixed gas stream to provide purified hydrogen via line 535 and one or more waste gases via line 539. In one or more embodiments, the hydrogen separators 535 can utilize one or more gas separation technologies including, but not limited to, pressure swing absorption, cryogenic distillation, semi-permeable membranes, or any combination thereof. Suitable absorbents can include caustic soda, potassium carbonate or other inorganic bases, and/or alanolamines.

In one or more embodiments, the one or more hydrogen separators 535 can provide a carbon dioxide-rich waste gas via line 539, and a hydrogen-rich product via line 537. In one or more embodiments, at least a portion of the hydrogen-rich product via line 537 can be used as a feed to one or more fuel cells 540. In one or more embodiments, at least a portion of the hydrogen-rich product via line 537 can be combined with at least a portion of the treated syngas in line 521 prior to use as a fuel in the one or more combustors 545. Although not shown, at least a portion of the hydrogen-rich product via line 537 can be recycled to line 33 to provide at least a portion of the carrier fluid. In one or more embodiments, the hydrogen-rich product in line 537 can be used in one or more downstream operations, which can include, but are not limited to, hydrogenation processes, fuel cell energy processes, ammonia production, and/or hydrogen fuel. For example, the hydrogen-rich product in line 537 can be used to make electricity using one or more hydrogen fuel cells 540.

In one or more embodiments, at least a portion of the treated syngas in line 521 can be combined with one or more oxidants introduced via line 543 and combusted in one or more combustors 545 to provide a high pressure/high temperature exhaust gas via line 547. The exhaust gas in line 547 can be passed through one or more turbines 550 and/or heat recovery systems 560 to provide mechanical power, electrical power and/or steam. The exhaust gas via line 547 can be introduced to one or more gas turbines 550 to provide an exhaust gas via line 551 and mechanical shaft power to drive the one or more electric generators 555. The exhaust gas via line 551 can be introduced to one or more heat recovery systems 560 to provide steam via line 90. In one or more embodiments, a first portion of the steam via line 90 can be introduced to one or more steam turbines 570 to provide mechanical shaft power to drive one or more electric generators 575. In one or more embodiments, a second portion of the steam via line 90 can be introduced to the gasifier 45, and/or other auxiliary process equipment (not shown). Although not shown, in one or more embodiments, steam via line 90 and/or 513 can be introduced to the one or more strippers 311, 343 (as shown in FIG. 3) or 311, 343, and 419 (as shown in FIG. 4). Although not shown, in one or more embodiments steam from an external source can be introduced to line 90 to provide all or a portion of the steam introduced the gasifier 45 or feed 30. In one or more embodiments, lower pressure steam from the one or more steam turbines 570 can be recycled to the one or more heat recovery systems 560 via line 577. In one or more embodiments, residual heat from line 577 can be rejected to a condensation system well known to those skilled in the art or sold to local industrial and/or commercial steam consumers.

In one or more embodiments, the heat recovery system 560 can be a closed-loop heating system, e.g. a waste heat boiler, shell-tube heat exchanger, and the like, capable of exchanging heat between the exhaust gas introduced via line 551 and the lower pressure steam introduced via line 577 to produce steam via line 90. In one or more embodiments, the heat recovery system 560 can provide up to 10,350 kPa (1,487 psig), 600° C. (1,112° F.) superheat/reheat steam without supplemental fuel.

Figure 6:
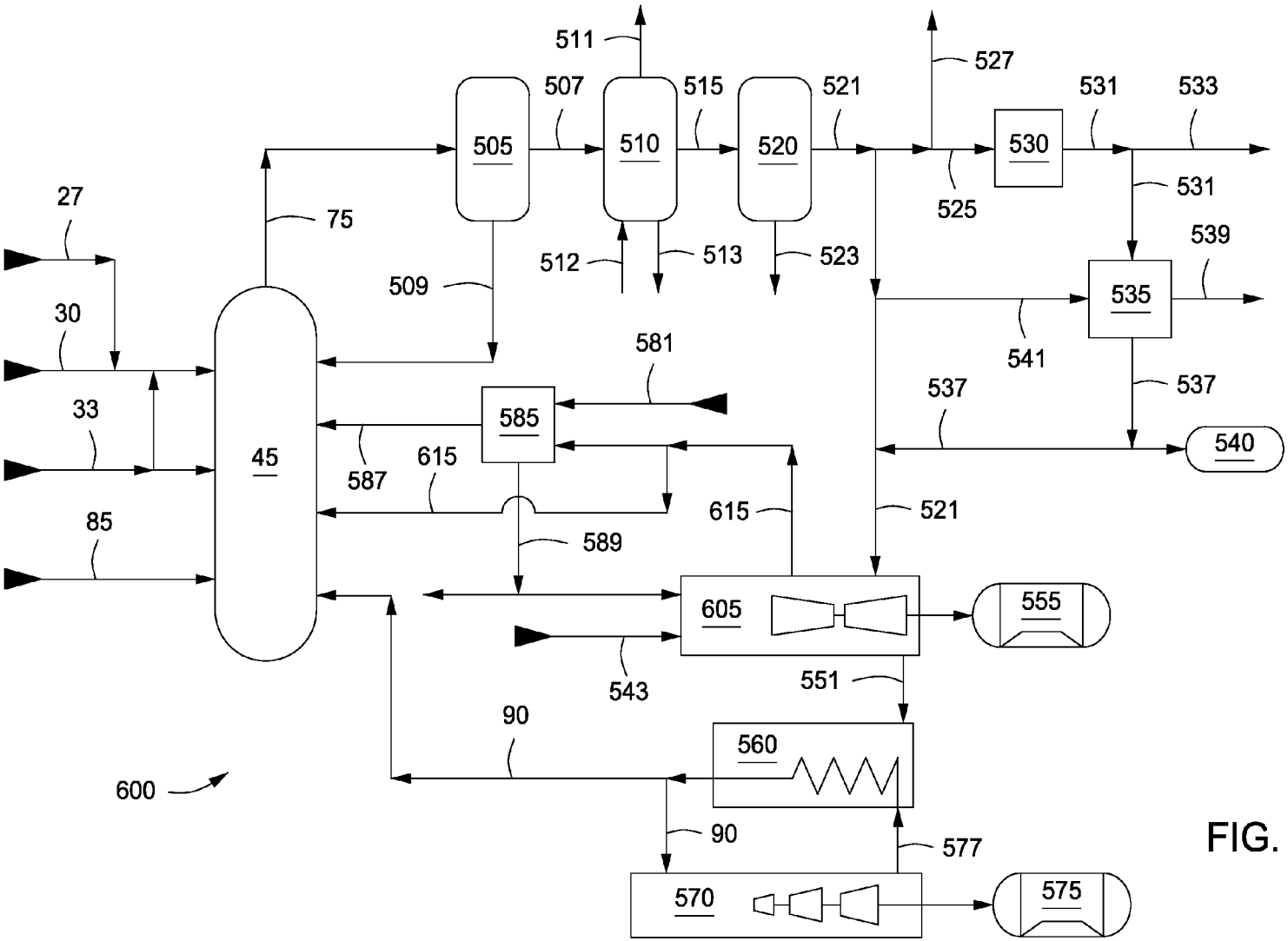
FIG. 6 depicts another illustrative gasification system for use with an integrated deasphalting and gasification system, according to one or more embodiments described.

FIG. 6 depicts another illustrative gasification system 600 for use with an integrated deasphalting and gasification system, according to one or more embodiments. In one or more embodiments, the gasification system can include one or more combustion turbines 605 to further enhance energy efficiency of the gasification system. The one or more gasifiers 45, one or more particulate removal systems 505, one or more product separation and cooling systems 510, one or more syngas purification systems 520, one or more gas converters 530, one or more hydrogen separators 535, one or more heat recovery systems 560, one or more steam turbines 575, one or more generators 555, 575, and one or more ASUs 585 can be as discussed and discussed above in reference to FIG. 5. In one or more embodiments, the gasification system 600 can include the one or more combustion turbines 605 in place of or in addition to the one or more combustors 545 and one or more gas turbines 550 depicted in FIG. 5.

In one or more embodiments, the treated syngas in line 521 can be introduced to the one or more combustion turbines 605. In one or more embodiments, the treated syngas in line 521 can be mixed with the hydrogen-rich product via line 537 and introduced to one or more combustion turbines 605. The one or more combustion turbines 605 can produce a high temperature exhaust gas via line 551 and shaft power to drive the one or more generators 555. In one or more embodiments, heat from the combustion turbine exhaust gas (generally about 600° C. (1,112° F.)) can be recovered using the one or more heat recovery systems 560 to generate steam via line 90 for subsequent use in a steam turbine 570 and/or gasifier 45.

In one or more embodiments, ambient air via line 543 can be compressed within a compressor stage of the combustion turbine 605 to provide compressed air via line 615, which can be introduced to the gasifier 45 and/or the ASU 585. In one or more embodiments, at least a portion of the nitrogen-rich waste gas via line 589 can be purged, sold as a commodity, and/or at least a portion can be introduced to the one or more combustion turbines 605 to reduce nitrogen oxide ($NO_x$) emissions by lowering the combustion temperature in the combustion turbine 605. Within the combustion turbine 605, the nitrogen can act as a diluent with no heating value, i.e. a heat sink. To further minimize $NO_x$ formation, the syngas and/or syngas and hydrogen mixture via line 521 entering the one or more combustion turbines 605 can be saturated with water (not shown).

Figure 7:
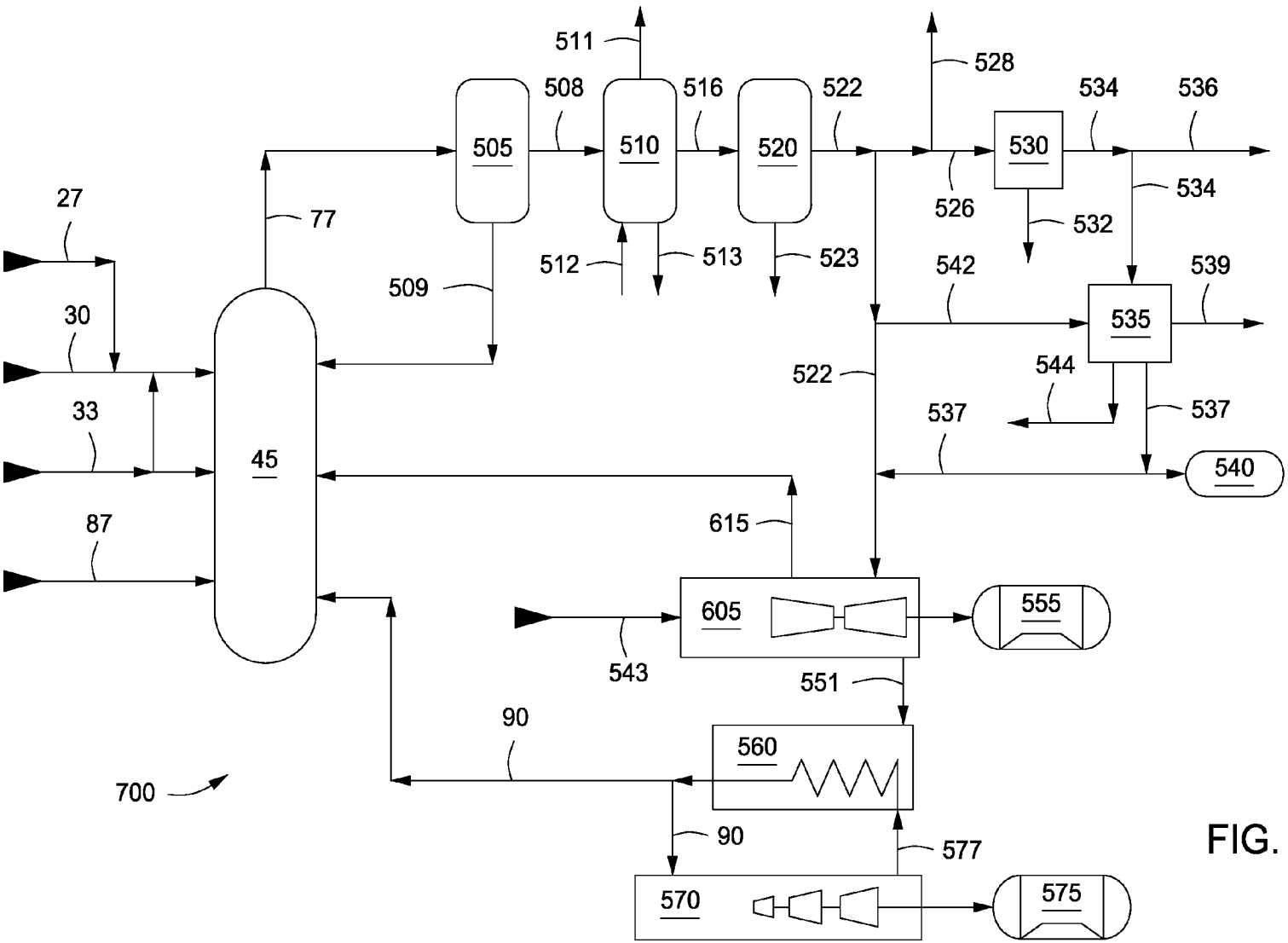
FIG. 7 depicts yet another illustrative gasification system for use with an integrated deasphalting and gasification system, according to one or more embodiments described.

FIG. 7 depicts yet another illustrative gasification system 700 for use with an integrated deasphalting and gasification system, according to one or more embodiments. The one or more gasifiers 45, one or more particulate removal systems 505, one or more product separation and cooling systems 510, one or more syngas purification systems 520, one or more gas converters 530, one or more hydrogen separators 535, one or more fuel cells 540, one or more combustion turbines 605, one or more heat recovery systems 560, one or more steam turbines 570, and one or more generators 555, 575 can be as described and discussed above in reference to FIGS. 5 and 6. Although not shown, the gasification system 700 can include one or more combustors 545 and one or more gas turbines 550 as discussed and described above in reference to FIG. 5.

The gasification system 700 can use one or more nitrogen-containing oxidants, which can be introduced via line 87 and/or line 615, or any other source for gasification to provide one or more products via line 77. The one or more nitrogen-containing oxidants can include air, oxygen-enriched air, mixtures of oxygen and air, mixtures of oxygen and nitrogen, or any other suitable nitrogen containing oxidant. The nitrogen-containing oxidant can contain about 20% vol or more oxygen, or about 25% vol or more oxygen, or about 30% vol or more oxygen. The nitrogen-containing oxidant can contain at least 5% vol nitrogen. The nitrogen content of the nitrogen-containing oxidant can range from a low of about 5% vol, 10% vol, or 20% vol to a high of about 25% vol, 50% vol, or 80% vol. In one or more embodiments, the asphaltene-rich mixture via line 30, carbonaceous feed via line 27, and/or carrier fluid via line 33 can be introduced to the gasifier 45 as discussed and described above in reference to FIGS. 1-6.

The one or more products from the gasifier 45 via line 77 can be introduced to the one or more particulate removal systems 505 which can be used to partially or completely remove solids from the one or more products to provide separated solids via line 509 and solids-lean products and nitrogen via line 508. As discussed and described above in reference to FIG. 5, the one or more product separation and cooling systems 510 can provide one or more hydrocarbon products via line 511. A heat transfer or cooling medium via line 512 can be introduced to the one or more product separation units 512, which can be recovered via line 513. In one or more embodiments, a syngas containing nitrogen via line 516 can be recovered from the one or more product separation and cooling systems 510.

The syngas purification system 520 can remove contaminants to provide a waste gas via line 523 and a treated syngas which can contain nitrogen via line 522. In one or more embodiments, at least a portion of the treated syngas in line 522 can be recovered via line 528 and sold as a commodity. In one or more embodiments, at least a portion of the treated syngas via line 522 can be introduced to one or more gas converters 530 via line 526 to provide a converted syngas via line 534. The one or more gas converters 530 can include cryogenic or membrane type systems for separating at least a portion of the nitrogen from the treated syngas via line 526 to provide a Fischer-Tropsch feed containing hydrogen cyanide and ammonia in amounts of about 20 ppbv or less, or about 10 ppbv or less. Nitrogen removal systems can also be used to maintain the nitrogen concentration within the system. Nitrogen can be recovered and/or purged from the system via line 532.

In one or more embodiments, at least a portion of the converted syngas in line 534 can be sold or upgraded using further downstream processes (not shown), which can be introduced via The one or more hydrogen separators 535 can include one or more nitrogen separation units to remove at least a portion of the nitrogen to provide nitrogen free or essentially nitrogen-free hydrogen via line 537, and/or nitrogen-free or essentially nitrogen-free, carbon dioxide via line 539. The separated nitrogen can be recovered and/or purged from the system via line 544.

At least a portion of the hydrogen via line 537 can be used as a feed to one or more fuel cells 540. As described and discussed above with reference to FIG. 5, at least a portion of the hydrogen 537 can be combined with the treated syngas via line 522 prior to use as a fuel in the one or more combustors 545 (not shown). At least a portion of the hydrogen via line 537 can be combined with the treated syngas via line 522 prior to use as a fuel in the one or more combustion turbines 605. In one or more embodiments, ambient air via line 543 can be compressed within a compressor stage of the combustion turbine 605 to provide compressed air via line 615, which can be introduced to the gasifier 45. The one or more combustion turbines 605 can provide a turbine exhaust via line 551 and shaft power to one or more electric generators 555. The hydrogen via line 537 can include varying amounts of nitrogen depending on the nitrogen content of the treated syngas via line 522, converted syngas via line 537, and/or the amount of nitrogen removed in the gas converter 530 and/or hydrogen separator 535.

Heat from the combustion turbine exhaust gas via line 551 can be recovered using the one or more heat recovery systems 560 to generate steam via line 90 which can be introduced to the gasifier 45, or introduced to the steam turbine 570, which can provide shaft power to the one or more electric generators 575, and/or other auxiliary steam consuming process equipment (not shown). Although not shown, in one or more embodiments, steam via line 90 and/or 513 can be introduced to the one or more strippers 311, 343 (as shown in FIG. 3) or 311, 343, and 419 (as shown in FIG. 4). In one or more embodiments, lower pressure steam from the one or more steam turbines 570 can be recycled to the one or more heat recovery systems 560 via line 577. In one or more embodiments, residual heat from line 577 can be rejected to a condensation system well known to those skilled in the art or sold to local industrial and/or commercial steam consumers.

Certain embodiments and features have been described using a set of numerical upper limits and a set of numerical lower limits. Ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for processing hydrocarbons comprising:

mixing a hydrocarbon comprising one or more asphaltenes and one or more non-asphaltenes with a solvent, the hydrocarbon having a specific gravity of from about 6° API to about 25° API, as measured according to ASTM D4052 at 15.6° C., and wherein a ratio of the solvent to the hydrocarbon is about 2:1 to about 10:1;

selectively separating the asphaltenes from the non-asphaltenes;

vaporizing a portion of the asphaltenes in the presence of gasified hydrocarbons and combustion gas;

cracking a portion of the asphaltenes at a temperature sufficient to provide a cracked gas comprising more than 0.5% vol $C_1$-$C_3$ hydrocarbons, more than 0.5% vol $C_4$-$C_6$ hydrocarbons, and more than 1% vol $C_7$-$C_9$ hydrocarbons;

depositing liquid asphaltenes, solid asphaltenes, or both onto one or more solids to provide one or more hydrocarbon containing solids;

selectively separating the cracked gas from the hydrocarbon containing solids;

combusting a portion of the hydrocarbon containing solids to provide the combustion gas; and gasifying the hydrocarbon containing solids to provide the gasified hydrocarbons and to regenerate the solids.

2. The method of claim 1, further comprising introducing a carbonaceous material, a carrier fluid, or both to the asphaltenes before vaporizing and cracking the asphaltene-rich product.

3. The method of claim 2, wherein the carbonaceous material comprises biomass, coal, oil shale, coke, tar, asphaltenes, low ash polymers, no ash polymers, hydrocarbon-based polymeric materials, polyethylene terephthalate, poly blends, poly-hydrocarbons containing oxygen, heavy hydrocarbon sludge, bottoms products, hydrocarbon waxes, discarded consumer products, one or more recycled plastics, derivatives thereof, or mixtures thereof.

4. The method of claim 1, further comprising selectively separating the asphaltenes before vaporizing and cracking at least a portion of the asphaltenes to provide a recovered solvent and solvent lean asphaltenes; and introducing at least a portion of the recovered solvent to the mixture.

5. The method of claim 1, further comprising selectively separating the non-asphaltenes to provide a deasphalted oil and a recovered solvent; and introducing at least a portion of the recovered solvent to the mixture.

6. The method of claim 5, further comprising cracking at least a portion of the deasphalted oil.

7. The method of claim 1, further comprising selectively separating the non-asphaltenes at a temperature at least equal to the critical temperature of the solvent and at a pressure at least equal to the critical pressure of the solvent to provide a light deasphalted oil and a heavy deasphalted oil.

8. The method of claim 1, wherein the asphaltenes are vaporized and cracked at a temperature of about 500° C. or more.

9. The method of claim 1, wherein vaporizing a portion of the asphaltenes and cracking a portion of the asphaltenes occurs in the presence of less than about 5% vol oxygen.

10. The method of claim 1, wherein the solids comprise refractory oxides, rare earth modified refractory oxides, alkali earth metal refractory oxides, ash, or mixtures thereof.

11. A method for processing hydrocarbons comprising:

mixing a hydrocarbon comprising one or more asphaltenes and one or more non-asphaltenes with a solvent in a mixing zone, the hydrocarbon having a specific gravity of from about 6° API to about 25° API, as measured according to ASTM D4052 at 15.6° C., and wherein a ratio of the solvent to the hydrocarbon is from about 2:1 to about 10:1;

selectively separating the asphaltenes from the non-asphaltenes in a separation zone;

vaporizing a portion of the asphaltenes in the presence of gasified hydrocarbons and combustion gas in a vaporization zone;

cracking a portion of the asphaltenes in a cracking zone at a temperature sufficient to provide a cracked gas comprising more than 5% vol $C_1$-$C_3$ hydrocarbons, more than 5% vol $C_4$-$C_6$ hydrocarbons, and more'than 1% vol $C_7$-$C_9$ hydrocarbons;

depositing liquid asphaltenes, solid asphaltenes, or both onto one or more solids in a deposition zone to provide one or more hydrocarbon containing solids;

selectively separating the cracked gas from the hydrocarbon containing solids in a separation zone;

combusting a portion of the hydrocarbon containing solids in a combustion zone to provide the combustion gas; and gasifying the hydrocarbon containing solids in a gasification zone to provide the gasified hydrocarbons and to regenerate the solids.

12. The method of claim 11, wherein the separation zone is at a pressure at least equal to the critical pressure of the solvent.

13. The method of claim 11, further comprising selectively separating at least a portion of the asphaltenes in a second separation zone to provide a recovered solvent and solvent lean asphaltenes.

14. The method of claim 11, further comprising introducing a carbonaceous material, a carrier fluid, or both to the asphaltenes before vaporizing and cracking the asphaltenes.

15. The method of claim 14, wherein the carbonaceous material comprises biomass, coal, oil shale, coke, tar, asphaltenes, low ash polymers, no ash polymers, hydrocarbon-based polymeric materials, polyethylene terephthalate, poly blends, poly-hydrocarbons containing oxygen, heavy hydrocarbon sludge, bottoms products, hydrocarbon waxes, discarded consumer products, one or more recycled plastics, derivatives thereof, or mixtures thereof.

16. The method of claim 11, further comprising selectively separating the non-asphaltenes in a second separation zone at a temperature at least equal to the critical temperature of the solvent and at a pressure at least equal to the critical pressure of the solvent to provide a light deasphalted oil and a heavy deasphalted oil.

17. The method of claim 11, wherein the asphaltenes are vaporized and cracked at a temperature of about 500° C. or more.

18. The method of claim 11, further comprising reacting at least a portion of the gasified hydrocarbons to provide methanol, alkyl formates, dimethyl ether, ammonia, one or more Fischer-Tropsch products, derivatives thereof, or combinations thereof.

19. The method of claim 11, wherein the solids comprise refractory oxides, rare earth modified refractory oxides, alkali earth metal refractory oxides, ash, or mixtures thereof.

20. A method for processing hydrocarbons comprising:

mixing a hydrocarbon comprising one or more asphaltenes and one or more non-asphaltenes with a solvent in a mixing zone, the hydrocarbon having a specific gravity of from about 6° API to about 25° API, as measured according to ASTM D4052 at 15.6° C., and wherein a ratio of the solvent to the hydrocarbon is about 2:1 to about 10:1;

selectively separating the asphaltenes from the non-asphaltenes in a first separation zone at a pressure at least equal to the critical pressure of the solvent;

selectively separating the non-asphaltenes in a second separation zone at a temperature at least equal to the critical temperature of the solvent and at a pressure at least equal to the critical pressure of the solvent to provide a light deasphalted oil and a heavy deasphalted oil;

vaporizing a portion of the asphaltenes in a vaporization zone in the presence of gasified hydrocarbons, combustion gas, and less than 0.5% vol oxygen;

cracking a portion of the asphaltenes in a cracking zone at a temperature sufficient to provide a cracked gas comprising more than 0.5% vol $C_1$-$C_3$ hydrocarbons, more than 0.5% vol $C_4$-$C_6$ hydrocarbons, and more than 0.5% vol $C_7$-$C_9$ hydrocarbons;

depositing liquid asphaltenes, solid asphaltenes, or both onto one or more solids in a deposition zone to provide one or more hydrocarbon containing solids;

selectively separating the cracked gas from the hydrocarbon containing solids in a separation zone;

combusting a portion of the solids in the presence of less than about 5% vol oxygen in a combustion zone to provide the combustion gas; and gasifying the hydrocarbon containing solids in a gasification zone to provide the gasified hydrocarbons and to regenerate the solids.

* * * * *